US006407728B1

(12) United States Patent
Sekine

(10) Patent No.: US 6,407,728 B1
(45) Date of Patent: Jun. 18, 2002

(54) ACTIVE MATRIX LIQUID CRYSTAL DISPLAY DEVICE HAVING SIGNAL SELECTORS AND METHOD OF DRIVING THE SAME

(75) Inventor: Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/435,968

(22) Filed: Nov. 8, 1999

(30) Foreign Application Priority Data

Nov. 6, 1998 (JP) ..... 10-315692

(51) Int. Cl.[7] ..... G09G 3/36

(52) U.S. Cl. ..... 345/90; 345/92

(58) Field of Search ..... 345/87, 90, 91, 345/92, 98, 100, 103, 38, 50, 51, 53; 349/41, 42, 46, 47, 53

(56) References Cited

U.S. PATENT DOCUMENTS 4,818,991 A * 4/1989 Gay ..... 345/92
5,764,210 A * 6/1998 Moon ..... 345/90

* cited by examiner

*Primary Examiner*—Chanh Nguyen
(74) *Attorney, Agent, or Firm*—Young & Thompson

(57) ABSTRACT

The present invention provides a data driver circuit for an active matrix liquid crystal display device having an array of pixels aligned in matrix, and each column of the pixels having a pair of a separate data line and a separate column-common line which are separated from any other columns, wherein the data driver circuit has a plurality of selectors, each of which is connected to corresponding one of plural sets of the separate data line and the separate column-common line, so that each of the selectors selects any one of a first transmission of image signals through the selector to the data line and a second transmission of at least one column-common voltage onto the separate column-common line.

26 Claims, 16 Drawing Sheets

ACTIVE MATRIX LIQUID CRYSTAL DISPLAY DEVICE HAVING SIGNAL SELECTORS AND METHOD OF DRIVING THE SAME

BACKGROUND OF THE INVENTION

The present invention relates to a liquid crystal display device, and more particularly to an active matrix liquid crystal display device operable with an in plane switching mode and a method of driving the same.

It has been known that one of active material liquid crystal display devices is operable in in-plane switching mode, wherein liquid crystal molecules are switched in horizontal direction by applying an electric field to the liquid crystal molecules in the horizontal direction. The electric field is generated between two electrodes formed in a substrate in which thin film transistors are formed. This in-plane switching mode active material liquid crystal display device has, for example, been used for displays or monitors of computers such as note-type personal computers.

FIG. 1 is a circuit diagram illustrative of an equivalent circuit of a first conventional in-plane switching mode active material liquid crystal display device. The first conventional in-plane switching mode active material liquid crystal display device comprises a data driver circuit 1510, a gate driver circuit 1520 and a liquid crystal display panel 1530 which is connected to the data driver circuit 1510 and the gate driver circuit 1520. The liquid crystal display panel 1530 has an array of pixels 1540 which are aligned in matrix throughout the liquid crystal display panel 1530. The liquid crystal display panel 1530 also has a plurality of data lines 1531 which extend in parallel to each other in a first direction for transmission of data to the pixels 1540. The data lines 1531 are connected to the data driver circuit 1510. The liquid crystal display panel 1530 also has a plurality of gate lines 1533 which extend in parallel to each other but in a second direction perpendicular to the first direction along which the data lines 1531 extend. The gate lines 1533 are provided for transmission of gate control signals to the pixels 1540. The gate lines 1533 are connected to the gate driver circuit 1520. The pixels 1540 are positioned at crossing points of the data lines 1531 and the gate lines 1533. The liquid crystal display panel 1530 also has a single column-common electrode line 1532 which extends in parallel to each other but in the first direction perpendicular to the second direction along which the gate lines 1533 extend.

Each of the pixels 1540 is represented by a square-shaped broken line in FIG. 1. Each of the pixels 1540 further comprises a pixel transistor 1541, a storage capacitor 1542, a pixel electrode 1543 and a column-common electrode 1544. The pixel transistor 1541 comprises a thin film transistor formed in a substrate. The pixel transistor 1541 in each of the pixels 1540 has a gate electrode which is connected to corresponding one of the gate lines 1533. The pixel transistor 1541 in each of the pixels 1540 has a source electrode which is connected to corresponding one of the data lines 1531. The storage capacitor 1542 is connected between a drain electrode of the pixel transistor 1541 and a ground line. The pixel electrode 1543 in each of the pixels 1540 is connected to the drain electrode of the pixel transistor 1541. The column-common electrode 1544 in each of the pixels 1540 is connected to the single column-common electrode line 1532, so that an external voltage may be applied through the single column-common electrode line 1532 to the column-common electrode 1544 in each of the pixels 1540. The data lines 1531 are driven by the data driver circuit 1510. The gate lines 1533 are driven by the gate driver circuit 1520.

FIG. 2 is a timing chart illustrative of waveforms of a horizontal synchronizing signal Hsync, a column-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first conventional in-plane switching mode active material liquid crystal display device of FIG. 1.

The following descriptions are operations of writing image signals into pixels of the first conventional in-plane switching mode active material liquid crystal display device of FIG. 1. Pulse signals are sequentially outputted from output terminals of the gate driver circuit 1520 in synchronizing with the horizontal synchronizing signals Hsync of the image signal. The data driver circuit 1510 is operated to fetch the image signals with one horizontal time period unit in order to output the image signals onto the data lines 1531. Each pulse signal outputted from the gate driver circuit 1520 is transmitted on one of the gate lines 1533, whereby the pixel transistor 1541 having the gate electrode connected to the one of the gate lines 1533 turns ON, during which an image signal voltage Vvc outputted from the data driver circuit 1510 is applied through the pixel transistor 1541 into the pixel electrode 1543. On the other hand, a column-common voltage Vcom is applied to the column-common electrode 1544 through the single column-common electrode line 1532. Namely, the pixel electrode 1543 has the image signal voltage Vvc, whilst the column-common electrode 1544 has the column-common voltage Vcom. A potential difference of Vvc−Vcom is generated between the pixel electrode 1543 and the column-common electrode 1544. Namely, the pixel 1540 has the potential difference of Vvc−Vcom, which generates an electric field to be applied to liquid crystal molecules positioned between the pixel electrode 1543 and the column-common electrode 1544. The liquid crystal molecules are therefore switched.

The foregoing operations are repeated for one frame unit thereby to obtain a two-dimensional image.

The image signals to be applied to the pixel electrode are required to be changed in polarity with reference to the column-common electrode potential in every frame units. Namely the polarity inversion driving is carried out to the data driver circuit 1510 in order to obtain or secure a highly accurate intensity of the electric field applied to applied to the liquid crystal molecules. By contrast to the polarity inversion driving, if a direct current electric field would be applied to the liquid crystal molecules, an electrolysis of the liquid crystal molecules is caused to generate ions in the liquid crystal molecules, whereby the generated ions generate local electric fields which displaces the intensity of the electric field applied between the pixel electrode and the column-common electrode.

The above described in-plane switching mode active matrix liquid crystal display requires a higher driving voltage by 6 V than that of a twisted nematic mode active matrix liquid crystal display. In order to accomplish the polarity inversion driving, a high voltage of not less than 12 V is required to be applied to the liquid crystal panel.

Further, it is required for realizing intermediate gray scale display of full color with 256-gray scales that the accuracy of the voltage level applied to the pixel electrode is within ±several tens mV. The data driver circuit 1510 is required to have a high quality performance like that an output voltage range is not less than 12 V, and an error in voltage level of the output voltage is within ±several tens mV.

If the display is applied to the liquid crystal display panel having a resolution of extended graphics array (1024×768), the number of the output terminals of the data driver circuit is not less than 1024. It is thus required to suppress variations in output voltage level of those output terminals within ±several tends mV.

The above described conventional in plane switching mode active matrix liquid crystal display has he following problems.

The first problem is that it is quite difficult to design the data driver circuit having a large number of output terminals but is capable of highly accurate control to error of the output voltage level within ±several tends mV.

The second problem is that the polarity inversion driving requires application of a large voltage of two times of the signal voltage level to the pixel, whereby a consumed power of the data driver circuit is large.

In the above circumstances, it had been required to develop a novel in plane switching mode active matrix liquid crystal display device free from the above problems.

SUMMARY OF THE INVENTION

Accordingly, it is an object of the present invention to provide a novel in plane switching mode active matrix liquid crystal display device free from the above problems.

It is a further object of the present invention to provide a novel in plane switching mode active matrix liquid crystal display device which is capable of applying a highly accurate voltage level to a liquid crystal even if an off-set of an amplifier of a data driver circuit is varied.

It is a still further object of the present invention to provide a novel in plane switching mode activc matrix liquid crystal display device which is capable of reducing an operating amplitude voltage of the data driver circuit to reduce a power consumption.

It is yet a further object of the present invention to provide a novel in plane switching mode active matrix liquid crystal display device which is capable of reducing flicker.

It is an another object of the present invention to provide a novel method of driving an in plane switching mode active matrix liquid crystal display device free from the above problems.

It is further another object of the present invention to provide a novel method of driving an in plane switching mode active matrix liquid crystal display device which is capable of applying a highly accurate voltage level to a liquid crystal even if an off-set of an amplifier of a data driver circuit is varied.

It is still another object of the present invention to provide a novel method of driving an in plane switching mode active matrix liquid crystal display device which is capable of reducing an operating amplitude voltage of the data driver circuit to reduce a power consumption.

It is yet another object of the present invention to provide a novel method of driving an in plane switching mode active matrix liquid crystal display device which is capable of reducing flicker.

The present invention provides a data driver circuit for an active matrix liquid crystal display device having an array of pixels aligned in matrix, and each column of the pixels having a pair of a separate data line and a separate column-common line which are separated from any other columns, wherein the data driver circuit has a plurality of selectors, each of which is connected to corresponding one of plural sets of the separate data line and the separate column-common line, so that each of the selectors selects any one of a first transmission of image signals through the selector to the data line and a second transmission of at least one column-common voltage onto the separate column-common line The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DISCLOSURE OF THE INVENTION

Figure 1:
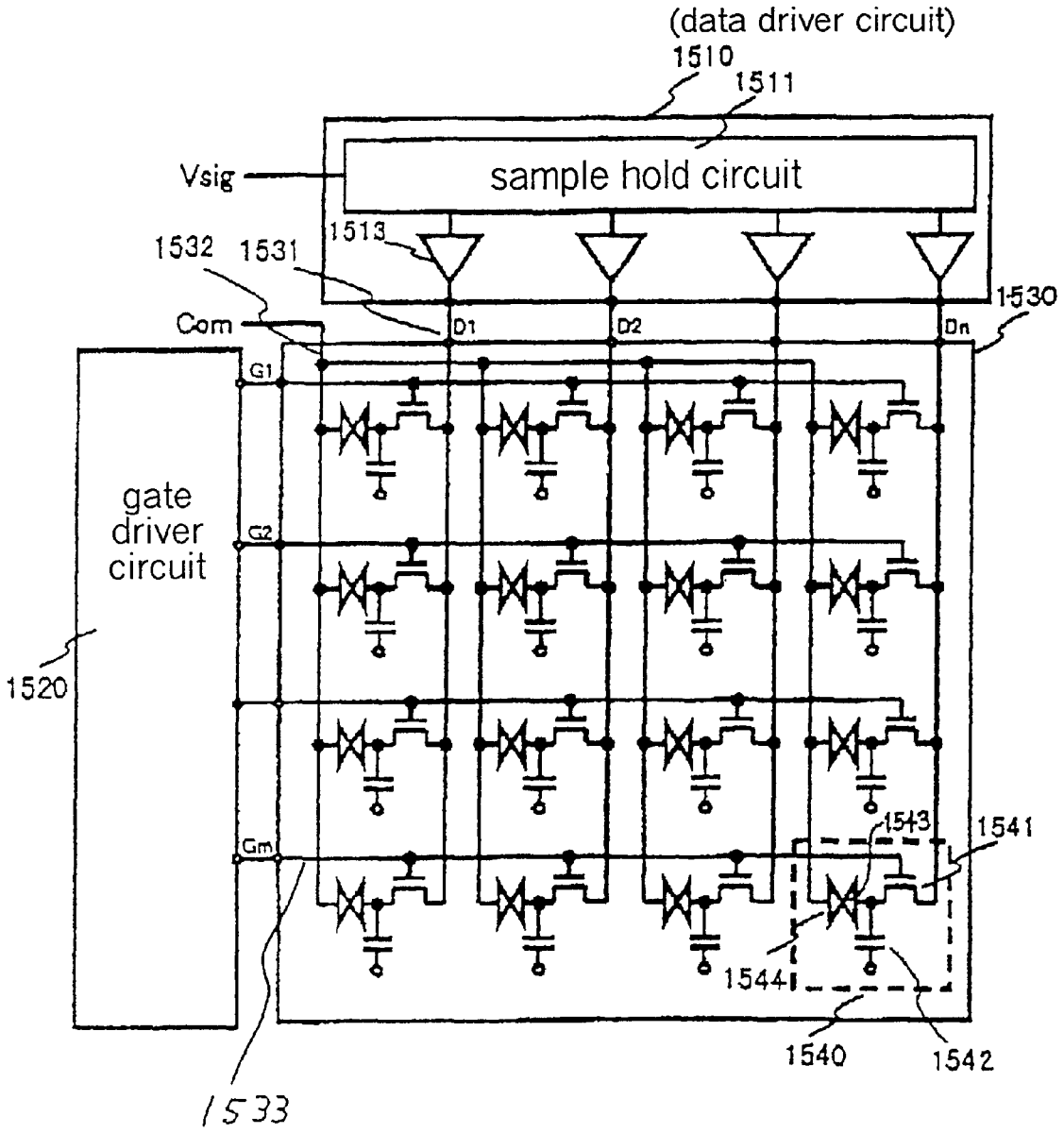
FIG. 1 prior art
FIG. 1 is a circuit diagram illustrative of an equivalent circuit of a first conventional in-plane switching mode active material liquid crystal display device.
Figure 2:
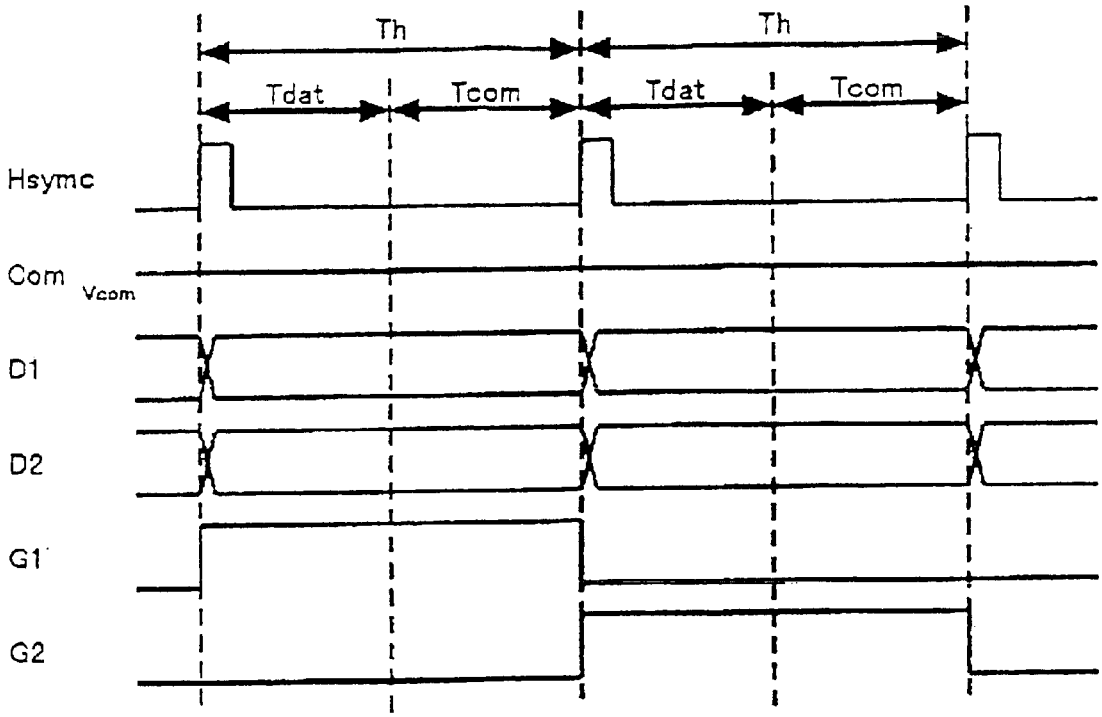
FIG. 2 prior art
FIG. 2 is a timing chart illustrative of waveforms of a horizontal synchronizing signal Hsync, a column-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first conventional in-plane switching mode active material liquid crystal display device of FIG. 1.

The present invention provides a data driver circuit for an active matrix liquid crystal display device having an array of pixels aligned in matrix, and each column of the pixels having a pair of a separate data line and a separate column-common line which are separated from any other columns, wherein the data driver circuit has a plurality of selectors, each of which is connected to corresponding one of plural sets of the separate data line and the separate column-common line, so that each of the selectors selects any one of a first transmission of image signals through the selector to the data line and a second transmission of at least one column-common voltage onto the separate column-common line.

It is preferable that each of the selectors has at least one amplifier for amplifying the image signals and the column-common voltage.

It is also preferable that the data driver comprises: at least a sample hold circuit for supplying image signals; a single panel-common line for transmission of a panel-common voltage; and a plurality of the selectors provided for every columns of the pixels, and also preferable that each of the selectors further comprises: a first switch connected to an output terminal of the sample hold circuit and also connected to the single panel-common line for selecting any one of the image signals and the panel-common voltage; an amplifier having an input terminal connected to the first switch for amplifying selected one of the image signals and the panel-common voltage; and a second switch connected to an output terminal of the amplifier for selecting any one of a first transmission of amplified image signals to the separate data line and a second transmission of amplified panel-common voltage to the separate column-common.

It is also preferable that the data driver circuit is separately provided from the array of the pixels.

It is also preferable that the data driver circuit is unitary provided with the array of the pixels.

It is also preferable that the data driver circuit comprises: at least a sample hold circuit for supplying image signals; a first panel-common line for transmission of a first panel-common voltage; a second panel-common line for transmission of a second panel-common voltage; and a plurality of the selectors provided for every columns of the pixels, the selectors being alternately connected to the first and second panel-common lines, and also preferable that each of the selectors further comprises: a first switch connected to an output terminal of the sample hold circuit and also connected to either the first or second panel-common line for selecting any one of the image signals and either the first or second panel-common voltage; an amplifier having an input terminal connected to the first switch for amplifying selected one of the image signals and the panel-common voltage; and a second switch connected to an output terminal of the amplifier for selecting any one of a first transmission of amplified image signals to the separate data line and a second transmission of amplified panel-common voltage to the separate column-common.

It is preferable that the data driver circuit is separately provided from the array of the pixels.

It is also preferable that the data driver circuit is unitary provided with the array of the pixels.

It is also preferable that the data driver circuit supplies the image signals which have a predetermined unchanged polarity with reference to the column-common voltage.

It is also preferable that the data driver circuit supplies the image signals which have alternatively inverted polarities with reference to the column-common voltage, where the polarities are alternatively inverted between in adjacent two frames.

The second present invention also provides a liquid crystal display device comprising: a display panel having an array of pixels aligned in matrix, and each column of the pixels having a pair of a separate data line and a separate column-common line which are separated from any other columns, and each row of the pixels having a gate line; a data driver circuit connected to the separate data lines and the separate column-common lines; and a gate driver circuit connected to the gate lines, wherein the data driver circuit has a plurality of selectors, each of which is connected to corresponding one of plural sets of the separate data line and the separate column-common line, so that each of the selectors selects any one of a first transmission of image signals through the selector to the data line and a second transmission of at least one column-common voltage onto the separate column-common line.

It is preferable that each of the selectors has at least one amplifier for amplifying the image signals and the column-common voltage.

It is also preferable that the data driver comprises: at least a sample hold circuit for supplying image signals; a single panel-common line for transmission of a panel-common voltage; and a plurality of the selectors provided for every columns of the pixels, and also preefrable that each of the selectors further comprises a first switch connected to an output terminal of the sample hold circuit and also connected to the single panel-common line for selecting any one of the image signals and the panel-common voltage; an amplifier having an input terminal connected to the first switch for amplifying selected one of the image signals and the panel-common voltage; and a second switch connected to an output terminal of the amplifier for selecting any one of a first transmission of amplified image signals to the separate data line and a second transmission of amplified panel-common voltage to the separate column-common.

It is preferable that the data driver circuit is separately provided from the array of the pixels.

It is also preferable that the data driver circuit is unitary provided with the array of the pixels.

It is also preferable that the data driver circuit comprises: at least a sample hold circuit for supplying image signals; a first panel-common line for transmission of a first panel-common voltage; a second panel-common line for transmission of a second panel-common voltage; and a plurality of the selectors provided for every columns of the pixels, the selectors being alternately connected to the first and second panel-common lines, and also preferable that each of the selectors further comprises: a first switch connected to an output terminal of the sample hold circuit and also connected to either the first or second panel-common line for selecting any one of the image signals and either the first or second panel-common voltage; an amplifier having an input terminal connected to the first switch for amplifying selected one of the image signals and the panel-common voltage; and a second switch connected to an output terminal of the amplifier for selecting any one of a first transmission of amplified image signals to the separate data line and a second transmission of amplified panel-common voltage to the separate column-common.

It is also preferable that the data driver circuit is separately provided from the array of the pixels.

It is also preferable that the data driver circuit is unitary provided with the array of the pixels.

It is also preferable that the data driver circuit supplies the image signals which have a predetermined unchanged polarity with reference to the column-common voltage.

It is also preferable that the data driver circuit supplies the image signals which have alternatively inverted polarities with reference to the column-common voltage, where the polarities are alternatively inverted between in adjacent two frames.

It is also preferable that the liquid crystal display device is an active matrix liquid crystal display device operated in in-plane switching mode.

The third present invention provides a liquid crystal display device having an array of pixels aligned in matrix, and each column of the pixels having a pair of a separate data line and a separate column-common line which are separated from any other columns, and each of the separate column-common lines being applied with independently and separately amplified column-common voltage.

The fourth present invention provides a method of driving a liquid crystal display device having an array of pixels aligned in matrix, and each column of the pixels having a pair of a separate data line and a separate column-common line which are separated from any other columns, wherein each of the separate column-common lines is applied with independently and separately amplified column-common voltage It is preferable that the data driver circuit supplies the image signals which have a predetermined unchanged polarity with reference to the column-common voltage.

It is also preferable that the data driver circuit supplies the image signals which have alternatively inverted polarities with reference to the column-common voltage, where the polarities are alternatively inverted between in adjacent two frames.

It is also preferable that the column-common voltage is applied in at least a predetermined time period which is within one horizontal time period and other than a writing time period for writing data.

It is also preferable that the column-common voltage is amplified by an amplifier which also serves to amplify the image signals to be transmitted onto a counter-part data line to the separate column-common line.

PREFERRED EMBODIMENT

Figure 3:
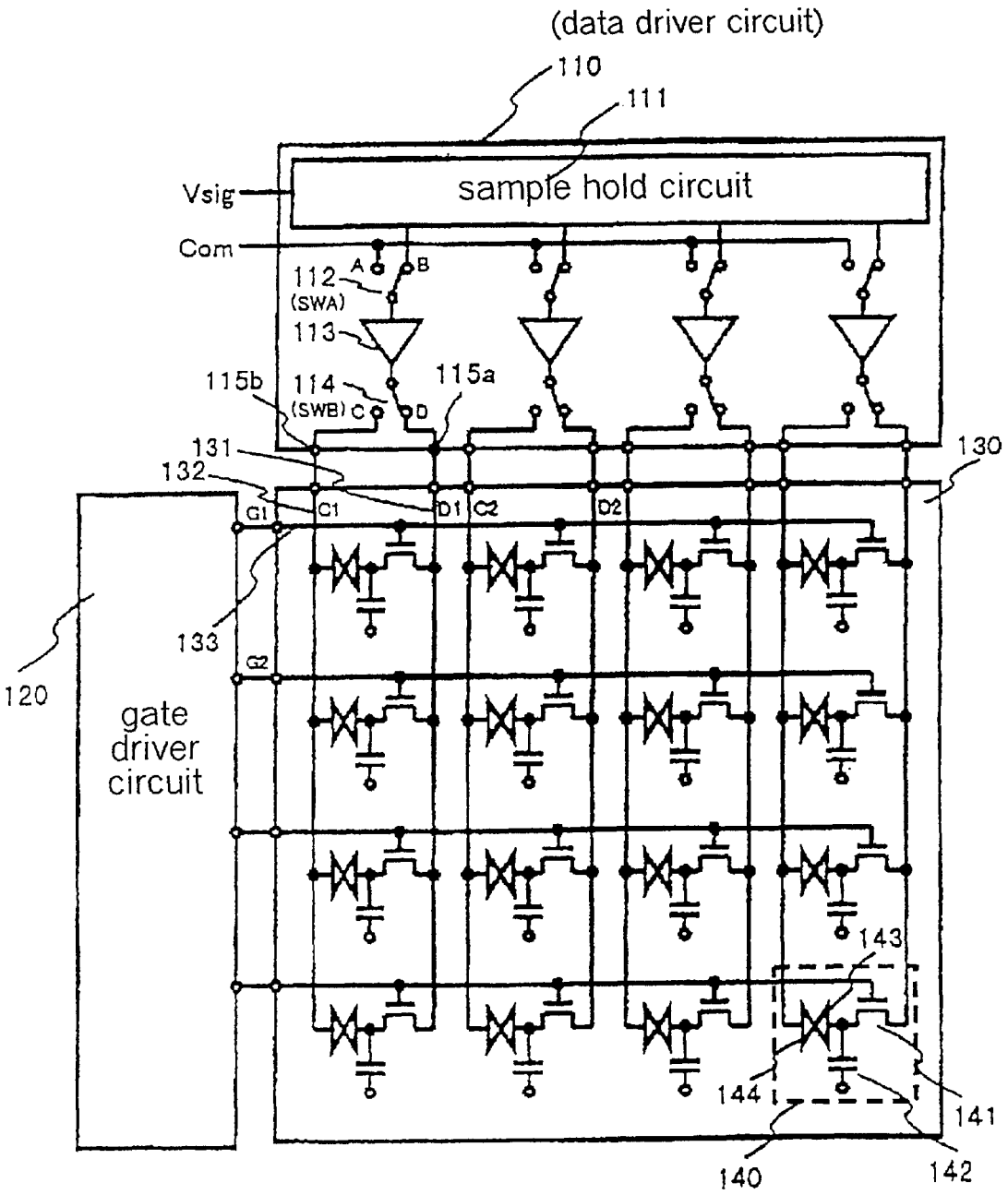
FIG. 3 is a circuit diagram illustrative of an equivalent circuit of a first novel in-plane switching mode active material liquid crystal display device in a first embodiment in accordance with the present invention.

A first embodiment according to the present invention will be described in detail with reference to the drawings FIG. 3 is a circuit diagram illustrative of an equivalent circuit of a first novel in-plane switching mode active material liquid crystal display device in a first embodiment in accordance with the present invention.

The first novel in-plane switching mode active material liquid crystal display device comprises a data driver circuit 110, a gate driver circuit 120 and a liquid crystal display panel 130 which is connected to the data driver circuit 110 and the gate driver circuit 120. The liquid crystal display panel 130 has an array of pixels 140 which are aligned in matrix throughout the liquid crystal display panel 130. The liquid crystal display panel 130 also has a plurality of data lines 131 which extend in parallel to each other in a column direction for transmission of data to the pixels 140. The data lines 131 are connected to the data driver circuit 110. The liquid crystal display panel 130 also has a plurality of gate lines 133 which extend in parallel to each other but in a row direction perpendicular to the column direction along which the data lines 131 extend. The gate lines 133 are provided for transmission of gate control signals to the pixels 140. The gate lines 133 are connected to the gate driver circuit 120. The pixels 140 are positioned at crossing points of the data lines 131 and the gate lines 133. The liquid crystal display panel 130 also has a plurality of separate column-common electrode lines 132 which extend in parallel to each other but in the column direction perpendicular to the row direction along which the gate lines 133 extend. The separate column-common electrode lines 132 are provided for every column alignments of the pixels 140, so that one of the separate column-common electrode lines 132 is provided for corresponding one column alignment of the pixels 140.

Each of the pixels 140 is represented by a square-shaped broken line in FIG. 3. Each of the pixels 140 further comprises a pixel transistor 141, a storage capacitor 142, a pixel electrode 143 and a column-common electrode 144. The pixel transistor 141 comprises a thin film transistor formed in a substrate. The pixel transistor 141 may comprise either an amorphous silicon thin film transistor or a polysilicon thin film transistor. The pixel transistor 141 in each of the pixels 140 has a gate electrode which is connected to corresponding one of the gate lines 133. The pixel transistor 141 in each of the pixels 140 has a source electrode which is connected to corresponding one of the data lines 131. The storage capacitor 142 is connected between a drain electrode of the pixel transistor 141 and a ground line. The pixel electrode 143 in each of the pixels 140 is connected to the drain electrode of the pixel transistor 141. The column-common electrode 144 in each of the pixels 140 is connected to corresponding one of the separate column-common electrode lines 132, so that a separately controlled column-common electrode voltage may be applied through the corresponding one of the separate column-common electrode lines 132 to the column-common electrode 144 of the pixels 140. The data lines 131 are driven by the data driver circuit 110. The gate lines 133 are driven by the gate driver circuit 120.

The data driver circuit 110 has a sample hold circuit 111, a plurality of first switches 112 provided for every columns of the pixels, a plurality of amplifiers 113 provided for every columns of the pixels, a plurality of second switches 114 provided for every columns of the pixels, plural pairs of an image signal output terminal 115*a* and a column-common voltage output terminal 115*b*. The sample hold circuit 111 is provided for sampling and holding image signals for one horizontal time period. Each of the plural first switches 112 is provided between the sample hold circuit 111 and corresponding one of the plural amplifiers 113. Each of the first switches 112 has a fixing terminal connected to an input terminal of the corresponding one of the amplifiers 113 and first and second switching terminals "A" and "B". The first switching terminal is connected to a single panel-common line "Com" extending in a row direction. All of the first switches 112 are connected through the first switching terminals "A" to the single panel-common line "Com". The second switching terminal "B" is connected to corresponding one of the output terminals of the sample hold circuit 111. Each of the first switches 112 is switched to connect the fixing terminal to either one of the first and second switching terminals "A" and "B" so that each of the first switches 112 switches in one horizontal time period to transmit either one of output voltage from the sample hold circuit 111 and a panel-common voltage level of the single panel-common line "Com". Each of the amplifiers 113 has an input terminal connected to the fixing terminal of the first switch 112 for receiving and amplifying selected one of the output voltage from the sample hold circuit 111 and a panel-common voltage level of the single panel-common line "Com". The second switch 114 is provided between the amplifier 113 and both corresponding one of the separated column-common electrode lines 132 and the corresponding data line 131 in the display panel 130. The second switch 114 has a fixing terminal connected to an output terminal of the amplifier 113 for receiving the amplified one of the output voltage from the sample hold circuit 111 and a panel-common voltage level of the single panel-common line "Com". The second switch 114 has a first switching terminal "C" connected to corresponding one of the separate column-common electrode lines 132 provided for every columns of the pixels in the display panel. The second switch 114 has a second switching terminal "D" connected to corresponding one of the data lines 131 provided for every columns of the pixels in the display panel. The first switching terminal "C" of the second switch 114 is connected to the column-common voltage output terminal 115*b* of the data driver circuit 110. The column-common voltage output terminal 115*b* is also connected to corresponding one of the corresponding one of the separate column-common electrode lines 132. The second switching terminal "D" of the second switch 114 is connected to the image signal output terminal 115*a* of the data driver circuit 111. The image signal output terminal 115*a* is also connected to corresponding one of the data lines 131. Each of the second switches 114 is switched to connect the fixing terminal to either one of the first and second switching terminals "C" and "D" so that each of the second switches 114 switches in one horizontal time period to either transmit the amplified image signal voltage to the data line 131 or transmit the amplified column-common electrode voltage to the corresponding separate column-common electrode line separately provided for the column. Namely, the first and second switches 112 and 114 are co-operated with each other so that, in one horizontal time period, the first switch 112 connects the fixing terminal and the first switching terminal "A" and the second switch 114 connects the fixing terminal and the first switching terminal "C" so as to connect the single panel-common line "Com" to the separated column-common electrode line 132 through the first and second switches 112 and 114 and the amplifier 113, whereby to transmit the amplified column-common voltage onto the separated column-common electrode line 132, and thus in the next horizontal time period, the first switch 112 switches to connect the fixing terminal and the second switching terminal "B" and the second switch 114 also switches to connect the fixing terminal and the first switching terminal "D" so as to connect the output terminal of the sample hold circuit 111 to the data line 131 through the first and second switches 112 and 114 and the amplifier 113, whereby to transmit the amplified image signal voltage onto the data line 131.

As described above, in accordance with the first novel in plane switching mode active matrix liquid crystal display device, the column-common electrode lines are separately provided for every columns for receiving column-common electrode voltages individually amplified by the amplifiers which serve to amplify the image signals for transmission thereof onto the counterpart data lines. The column-common electrode voltages individually amplified in every columns are written in horizontal blanking time periods, Namely, both the image signals to be transmitted onto the data line and the column-common voltages to be transmitted onto the counterpart separate column-common electrode line which makes the same column with the data line are amplified by the same amplifier, so that even if any variation in off-set is caused between the plural amplifiers, it is possible to cause a highly accurate potential difference between the pixel electrode applied with the image signal having been transmitted on the data line and the separate column-common electrode applied with the individual column-common voltage having been transmitted on the separate column-common electrode line, whereby an electric field with an highly accurate intensity is applied across the liquid crystal between the pixel electrode and the column-common electrode in each of the pixels.

The display panel is driven by an alternate current driving method, wherein the voltage to be applied across the liquid crystal between the pixel electrode and the column-common electrode is inverted or changed in polarity for every frames, Further, different column-common voltage levels are applied to the column-common electrode between a first frame in applying a positive polarity voltage to the pixel electrode and a second frame in applying a negative polarity voltage to the pixel electrode, so as to allow that an amplitude in voltage level of the image signals to be applied to the pixel electrode is reduced into about one half of that necessary when a fixed column-common voltage level remains applied to the column-common electrode between the first and second frames. This reduction in the necessary amplitude in voltage level of the image signals by applying the different column-common voltage levels to the column-common electrode between the first and second frames allows relaxing operational conditions of the amplifiers, namely makes it easy to design the amplifiers.

Figure 4:
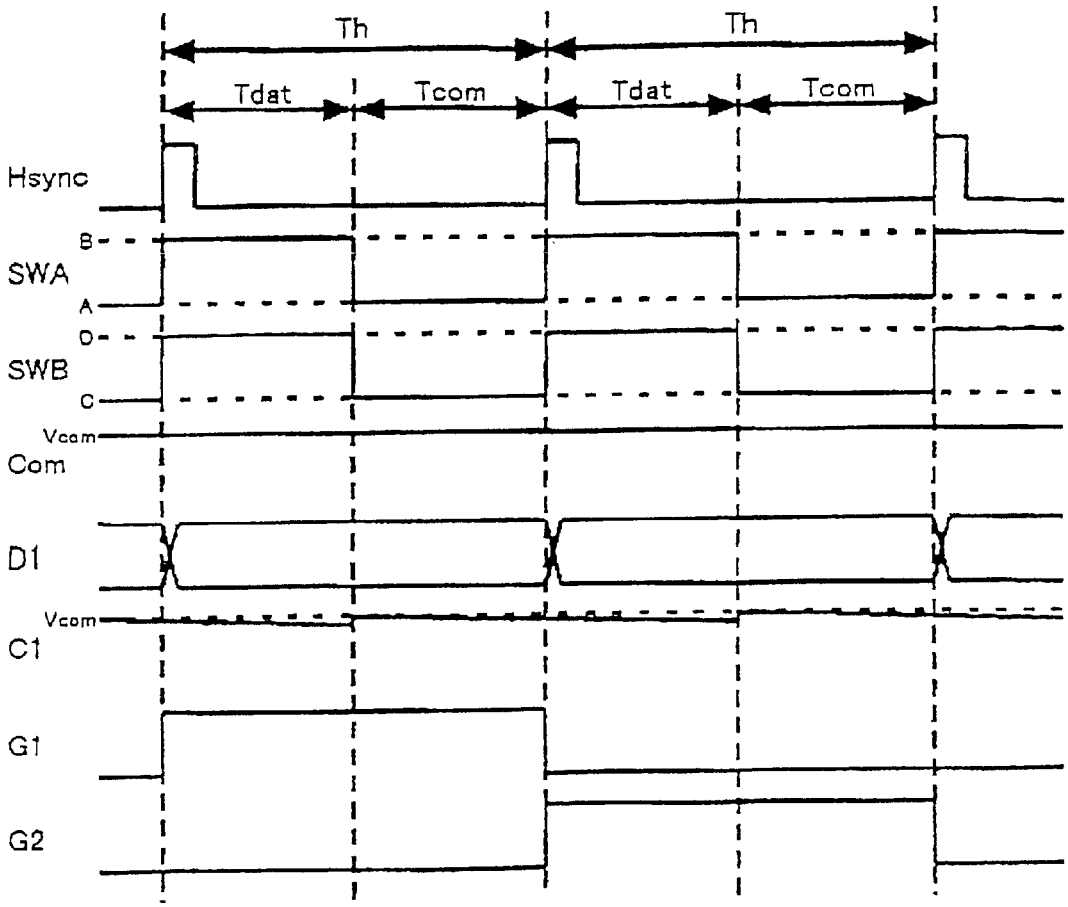
FIG. 4 is a timing chart illustrative of waveforms of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first novel in-plane switching mode active material liquid crystal display device of FIG. 3.

The following descriptions will focus on the operations of the above display device. FIG. 4 is a timing chart illustrative of waveforms of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first novel in-plane switching mode active material liquid crystal display device of FIG. 3.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 110 operates as follows. Each of the first switches 112 switches to connect the fixing terminal and the second switching terminal "B" so as to connect the input terminal of the amplifiers 113 to the sample hold circuit 111. Each of the second switches 114 switches to connect the fixing terminal and the second switching terminal "D" so as to connect the output terminal of the amplifiers 113 to the image signal output terminal 115*a* which is connected to the data line 131. Image signals held in the sample hold circuit 111 are transmitted through the amplifiers 113 into the data lines 131.

In the second half period "Tcom", the data driver circuit 110 operates as follows. Each of the first switches 112 switches to connect the fixing terminal and the first switching terminal "A" so as to connect the input terminal of the amplifiers 113 to the single panel-common line "Com". Each of the second switches 114 switches to connect the fixing terminal and the first switching terminal "C" so as to connect the output terminal of the amplifiers 113 to the column-common voltage output terminal 115*b* which is connected to the separate column-common electrode line 132. A common voltage Vcom of the single panel-common line "Com" is transmitted through the amplifier 113 to the separate column-common electrode line 132.

Each of the data lines 131 and the separate column-common electrode line 132 has a parasitic capacitance which is caused by the fact that each of the data lines 131 and the separate column-common electrode line 132 extends to cross over the gate lines 133. The data line 131 and the separate column-common electrode line 132 hold the voltages one charged by the previous switching operations.

If, in this horizontal time period, the gate line "G1" has a high level potential to place the pixel transistor 141 into ON-state, the image signal on the data line 131 is transmitted through the pixel transistor 141 into the pixel electrode 143 of the pixel capacitance and also into the storage capacitance 142, whereby the pixel capacitance and the storage capacitance 142 are charged in accordance with the image signal voltage level.

In the next horizontal time period, the data driver circuit 110 operates as follows. In the first half period "Tdat", each of the first switches 112 witches to connect the fixing terminal and the second switching terminal "B" so as to connect the input terminal of the amplifiers 113 to the sample hold circuit 111. Each of the second switches 114 switches to connect the fixing terminal and the second switching terminal "D" so as to connect the output terminal of the amplifiers 113 to the image signal output terminal 115*a* which is connected to the data line 131. Image signals held in the sample hold circuit 111 are transmitted through the amplifiers 113 into the data lines 131.

In the second half period "Tcom", the data driver circuit 110 operates as follows. Each of the first switches 112 switches to connect the fixing terminal and the first switching terminal "A" so as to connect the input terminal of the amplifiers 113 to the single panel-common line "Com". Each of the second switches 114 switches to connect the fixing terminal and the first switching terminal "C" so as to connect the output terminal of the amplifiers 113 to the column-common voltage output terminal 115*b* which is connected to the separate column-common electrode line 132. A common voltage Vcom of the single panel-common line "Com" is transmitted through the amplifier 113 to the separate column-common common electrode line 132.

Each of the data lines 131 and the separate column-common electrode line 132 has a parasitic capacitance which is caused by the fact that each of the data lines 131 and the separate column-common electrode line 132 extends to cross over the gate lines 133. The data line 131 and the separate column-common electrode line 132 hold the voltages one charged by the previous switching operations.

If, in this horizontal time period, the gate line "G2" has a high level potential to place the pixel transistor 141 into ON-state, the image signal on the data line 131 is transmitted through the pixel transistor 141 into the pixel electrode 143 of the pixel capacitance and also into the storage capacitance 142, whereby the pixel capacitance and the storage capacitance 142 are charged in accordance with the image signal voltage level.

The above operations are repeated for all of the gate lines G1, - - - Gm, so that image signals are written into all of the pixels.

The above first novel liquid crystal display device operated in the above first driving method provides the following effects.

The data driver circuit 110 has the same number of or a larger number of the amplifiers 113 than the data lines 131 of the display panel 130. It is assumed that there are variations in off-set voltage among the amplifiers 113. The output from the amplifier 113 is given by the following equation (1).

$$Vout=\alpha\times Vn+Voff \quad (1)$$

where Vout is the output voltage of the amplifier 113, $\alpha$ is the gain of the amplifier 113, Vin is the input voltage of the amplifier 113, Voff is the off-set set voltage of the amplifier 113.

If the above liquid crystal display is driven in the above described first driving method, then the following voltages are written into the pixel electrode 143 and the separate column-common electrode 114.

$$Vplc=\alpha\times Vvd+Voff \quad (2)$$

$$Vpcm=\alpha\times Vcom+Voff \quad (3)$$

where Vplc is the voltage to be written into the pixel electrode 143, Vpcm is the voltage to be written into the separate column-common electrode 144, Vvd is the image signal voltage, and Vcom is the common voltage of the single panel-common line Com.

A voltage Vlc to be applied to liquid crystal between the pixel electrode 143 and the separate column-common electrode 144 corresponds to a potential difference between the pixel electrode 143 and the separate column-common electrode 144, for which reason the voltage Vlc to be applied to liquid crystal may be represented by the following equation (4) using the above equations (2) and (3).

$$\begin{aligned} Vlc &= Vplc - Vpcm \quad (4) \\ &= (\alpha\times Vvd + Voff) - (\alpha\times Vcom + Voff) \\ &= \alpha\times(Vvd - Vcom) \end{aligned}$$

The equation (4) means that the voltage Vlc to be applied to liquid crystal is independent from the off-set voltage Voff of the amplifier 113. Accordingly, the voltage Vlc to be applied to liquid crystal is independent from variations in the off-set voltage Voff of the amplifiers 113. Namely, the voltage Vlc to be applied to liquid crystal remains unchanged even if there are variations in off-set voltage Voff among the amplifiers 113. The above first novel liquid crystal display operated in the above described first driving method is capable of applying a highly accurate voltage to the liquid crystal even if there are variations in off-set voltage Voff among the amplifiers 113.

Figure 5:
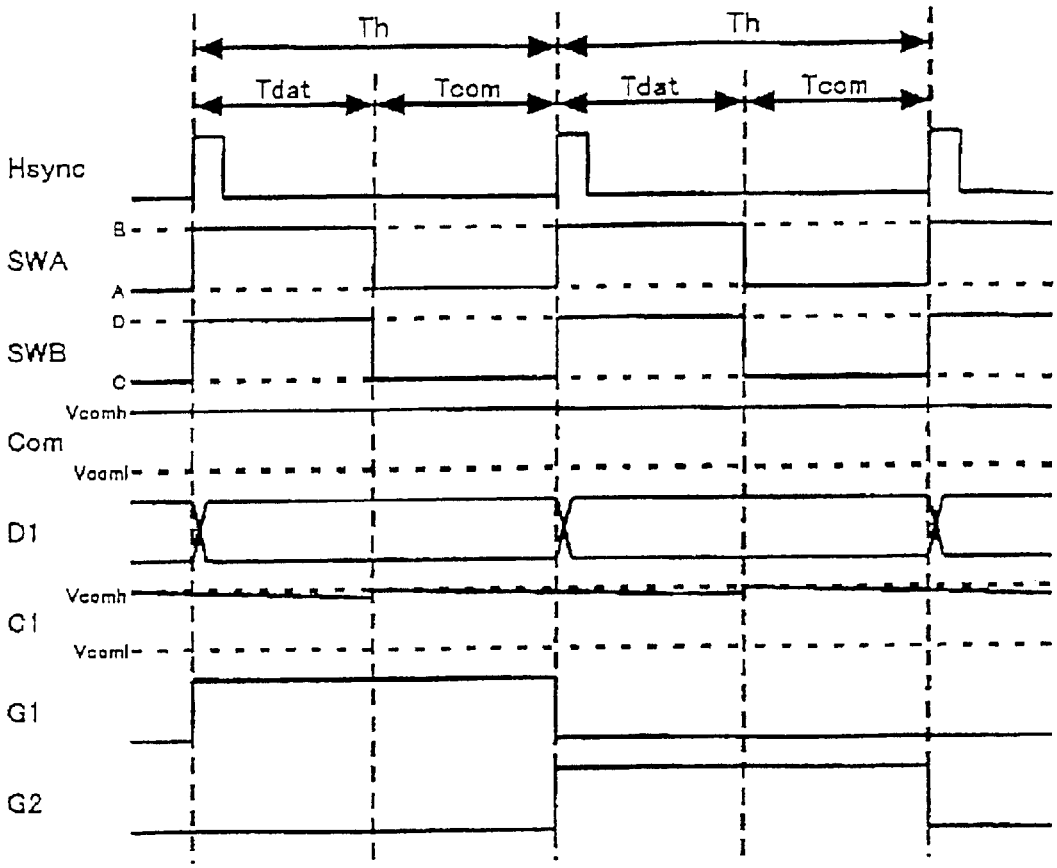
FIG. 5 is a timing chart illustrative of waveforms in even frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first novel in-plane switching mode active material liquid crystal display device of FIG. 3.
Figure 6:
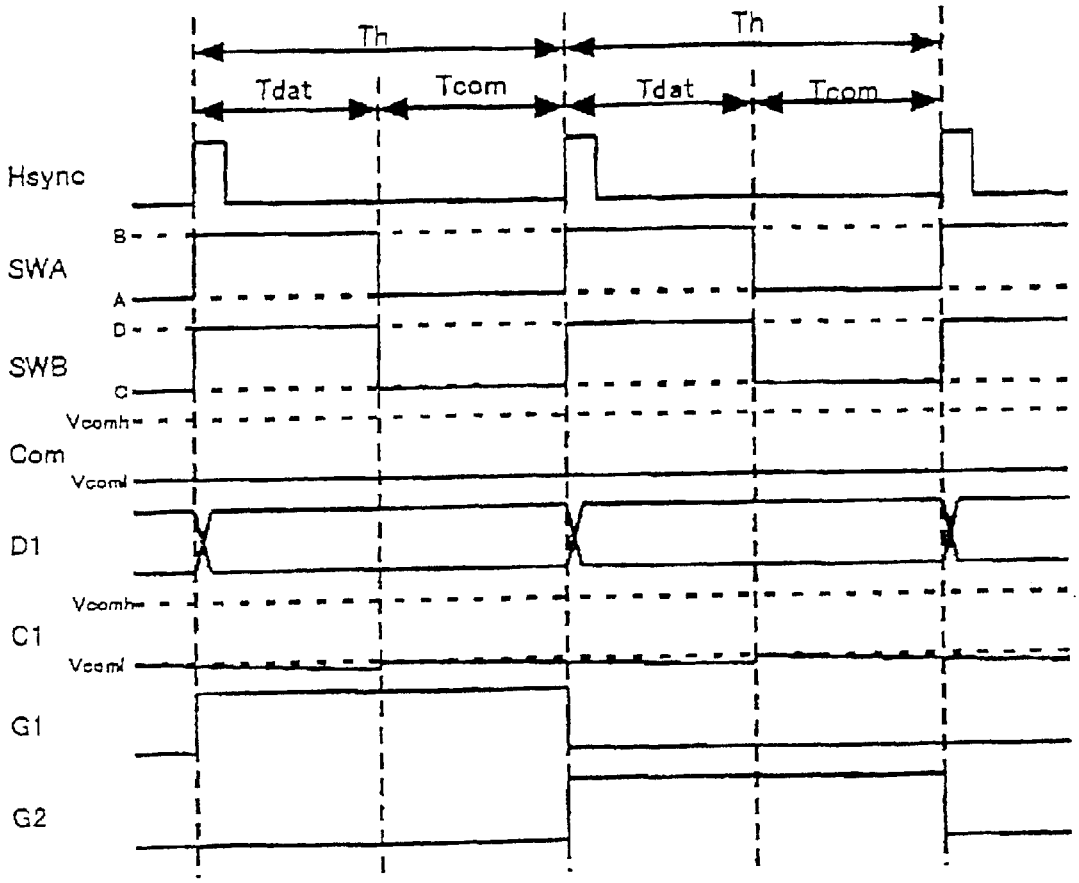
FIG. 6 is a timing chart illustrative of waveforms in odd frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first novel in-plane switching mode active material liquid crystal display device of FIG. 3.

The above first novel liquid crystal display device may be driven by the following second novel driving method. FIG. 5 is a timing chart illustrative of waveforms in even frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first novel in-plane switching mode active material liquid crystal display device of FIG. 3. FIG. 6 is a timing chart illustrative of waveforms in odd frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the first novel in-plane switching mode active material liquid crystal display device of FIG. 3.

With reference to FIG. 5, image signals to be written into the pixel electrodes 143 have negative polarity to the separate column-common voltages to be applied to the separate column-common electrodes 144. Images signals Vsig are supplied to the data driver circuit 110. The separate column-common electrodes 144 is applied with a voltage Vcomh and the date driver circuit 110 is applied with a voltage (−Vvd+Vcomh) in order to apply the voltage Vvd to the liquid crystal between the separate column-common electrodes 144 and the pixel electrodes 143.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 110 operates as follows. Each of the first switches 112 switches to connect the fixing terminal and the second switching terminal "B" so as to connect the input terminal of the amplifiers 113 to the sample hold circuit 111. Each of the second switches 114 switches to connect the fixing terminal and the second switching terminal "D" so as to connect the output terminal of the amplifiers 113 to the image signal output terminal 115*a* which is connected to the data line 131. Image signals held in the sample hold circuit 111 are transmitted through the amplifiers 113 into the data lines 131.

In the second half period "Tcom", the data driver circuit 110 operates as follows. Each of the first switches 112 switches to connect the fixing terminal and the first switching terminal "A" so as to connect the input terminal of the amplifiers 113 to the single panel-common line "Com". Each of the second switches 114 switches to connect the fixing terminal and the first switching terminal "C" so as to connect the output terminal of the amplifiers 113 to the column-common voltage output terminal 115*b* which is connected to the separate column-common electrode line 132. A common voltage Vcomn of the single panel-common line "Com" is transmitted through the amplifier 113 to the separate column-common electrode line 132.

Each of the data lines 131 and the separate column-common electrode line 132 has a parasitic capacitance which is caused by the fact that each of the data lines 131 and the separate column-common electrode line 132 extends to cross over the gate lines 133. The data line 131 and the separate column-common electrode line 132 hold the voltages one charged by the previous switching operations.

If, in this horizontal time period, the gate line "G1" has a high level potential to place the pixel transistor 141 into ON-state, the image signal on the data line 131 is transmitted through the pixel transistor 141 into the pixel electrode 143 of the pixel capacitance and also into the storage capacitance 142, whereby the pixel capacitance and the storage capacitance 142 are charged in accordance with the image signal voltage level.

In the next horizontal time period, the data driver circuit 110 operates as follows. In the first half period "dat", each of the first switches 112 switches to connect the fixing terminal and the second switching terminal "B" so as to connect the input terminal of the amplifiers 113 to the sample hold circuit 111. Each of the second switches 114 switches to connect the fixing terminal and the second switching terminal "D" so as to connect the output terminal of the amplifiers 113 to the image signal output terminal 115*a* which is connected to the data line 131. Image signals held in the sample hold circuit 111 are transmitted through the amplifiers 113 into the data lines 131.

In the second half period "Tcom", the data driver circuit 110 operates as follows. Each of the first switches 112 switches to connect the fixing terminal and the first switching terminal "A" so as to connect the input terminal of the amplifiers 113 to the single panel-common line "Com". Each of the second switches 114 switches to connect the fixing terminal and the first switching terminal "C" so as to connect the output terminal of the amplifiers 113 to the column-common voltage output terminal 115*b* which is connected to the separate column-common electrode line 132. A common voltage Vcom of the single panel-common line "Com" is transmitted through the amplifier 113 to the separate column-common electrode line 132.

Each of the data lines 131 and the separate column-common electrode line 132 has a parasitic capacitance which is caused by the fact that each of the data lines 131 and the separate column-common electrode line 132 extends to cross over the gate lines 133. The data line 131 and the separate column-common electrode line 132 hold the voltages one charged by the previous switching operations.

If, in this horizontal time period, the gate line "G2" has a high level potential to place the pixel transistor 141 into ON-state, the image signal on the data line 131 is transmitted through the pixel transistor 141 into the pixel electrode 143 of the pixel capacitance and also into the storage capacitance 142, whereby the pixel capacitance and the storage capacitance 142 are charged in accordance with the image signal voltage level.

The above operations are repeated for all of the gate lines G1, - - - Gm, so that image signals are written into all of the pixels.

With referenec to FIG. 6, in odd frames, image signals to be written into the pixel electrodes 143 have positive polarity to the separate column-common voltages to be applied to the separate column-common electrodes 144. Images signals Vsig are supplied to the data driver circuit 110. The separate column-common electrodes 144 is applied with a voltage Vcomh and the date driver circuit 110 is applied with a voltage (Vvd+Vcomh) in order to apply the voltage Vvd to the liquid crystal between the separate column-common electrodes 144 and the pixel electrodes 143.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 110 operates as follows. Each of the first switches 112 switches to connect the fixing terminal and the second switching terminal "B" so as to connect the input terminal of the amplifiers 113 to the sample hold circuit 111. Each of the second switches 114 switches to connect the fixing terminal and the second switching terminal "D" so as to connect the output terminal of the amplifiers 113 to the image signal output terminal 115*a* which is connected to the data line 131. Image signals held in the sample hold circuit 111 are transmitted through the amplifiers 113 into the data lines 131.

In the second half period "Tcom", the data driver circuit 110 operates as follows. Each of the first switches 112 switches to connect the, fixing terminal and the first switching terminal "A" so as to connect the input terminal of the amplifiers 113 to the single panel-common line "Com". Each of the second switches 114 switches to connect the fixing terminal and the first switching terminal "C" so as to connect the output terminal of the amplifiers 113 to the column-common voltage output terminal 115*b* which is connected to the separate column-common electrode line 132. A common voltage Vcom of the single panel-common line "Com" is transmitted through the amplifier 113 to the separate column-common electrode line 132.

Each of the data lines 131 and the separate column-common electrode line 132 has a parasitic capacitance which is caused by the fact that each of the data lines 131 and the separate column-common electrode line 132 extends to cross over the gate lines 133. The data line 131 and the separate column-common electrode line 132 hold the voltages one charged by the previous switching operations.

If, in this horizontal time period, the gate line "G1" has a high level potential to place the pixel transistor 141 into ON-state, the image signal on the data line 131 is transmitted through the pixel transistor 141 into the pixel electrode 143 of the pixel capacitance and also into the storage capacitance 142, whereby the pixel capacitance and the storage capacitance 142 are charged in accordance with the image signal voltage level.

In the next horizontal time period, the data driver circuit 110 operates as follows. In the first half period "Tdat", each of the first switches 112 switches to connect the fixing terminal and the second switching terminal "B" so as to connect the input terminal of the amplifiers 113 to the sample hold circuit 111. Each of the second switches 114 switches to connect the fixing terminal and the second switching terminal "D" so as to connect the output terminal of the amplifiers 113 to the image signal output terminal 115*a* which is connected to the data line 131. Image signals held in the sample hold circuit 111 are transmitted through the amplifiers 113 into the data lines 131.

In the second half period "Tcom", the data driver circuit 110 operates as follows. Each of the first switches 112 switches to connect the fixing terminal and the first switching terminal "A" so as to connect the input terminal of the amplifiers 113 to the single panel-common line "Com". Each of the second switches 114 switches to connect the fixing terminal and the first switching terminal "C" so as to connect the output terminal of the amplifiers 113 to the column-common voltage output terminal 115*b* which is connected to the separate column-common electrode line 132. A common voltage Vcom of the single panel-common line "Com" is transmitted through the amplifier 113 to the separate column-common electrode line 132.

Each of the data lines 131 and the separate column-common electrode line 132 has a parasitic capacitance which is caused by the fact that each of the data lines 131 and the separate column-common electrode line 132 extends to cross over the gate lines 133. The data line 131 and the separate column-common electrode line 132 hold the voltages one charged by the previous switching operations.

If, in this horizontal time period, the gate line "G2" has a high level potential to place the pixel transistor 141 into ON-state, the image signal on the data line 131 is transmitted through the pixel transistor 141 into the pixel electrode 143 of the pixel capacitance and also into the storage capacitance 142, whereby the pixel capacitance and the storage capacitance 142 are charged in accordance with the image signal voltage level.

The above operations are repeated for all of the gate lines G1, - - - Gm, so that image signals are written into all of the pixels.

The voltage Vlc to be applied in the even frames to the liquid crystal between the pixel electrodes 143 and the separate column-common electrodes 144 corresponds to a potential difference between the pixel electrode 143 and the separate column-common electrode 144. The voltage Vlc to be applied in the even frames to the liquid crystal is given by the following equation (5)

$$\begin{aligned} Vlc &= Vsig - Vcomh \qquad (5) \\ &= (-Vvd + Vcomh) - Vcomh \\ &= -Vvd \end{aligned}$$

Further, the voltage Vlc to be applied in the odd frames to the liquid crystal between the pixel electrodes 143 and the separate column-common common electrodes 144 corresponds to a potential difference between the pixel electrode 143 and the separate column-common electrode 144. The voltage Vlc to be applied in the odd frames to the liquid crystal is given by the following equation (6)

$$\begin{aligned} Vlc &= Vsig - Vcomh \qquad (6) \\ &= (Vvd + Vcomh) - Vcomh \\ &= Vvd \end{aligned}$$

In accordance with the second novel driving method, the image signals with the negative polarity are written in the even frames whilst the image signals with the positive polarity are written in the odd frames.

The above first novel liquid crystal display device operated in the above second driving method provides the following effects.

The data driver circuit 110 has the same number of or a larger number of the amplifiers 113 than the data lines 131 of the display panel 130. It is assumed that there are variations in off-set voltage among the amplifiers 113. The output from the amplifier 113 is given by the above equation (1).

If the above liquid crystal display is driven in the above described first driving method, then the voltages given by the above equations (2) and (3) are written into the pixel electrode 143 and the separate column-common electrode 114.

A voltage Vlc to be applied to liquid crystal between the pixel electrode 143 and the separate column-common electrode 144 corresponds to a potential difference between the pixel electrode 143 and the separate column-common electrode 144, for which reason the voltage Vlc to be applied to liquid crystal may be represented by the above equation (4).

The above equation (4) means that the voltage Vlc to be applied to liquid crystal is independent from the off-set voltage Voff of the amplifier 113. Accordingly, the voltage Vlc to be applied to liquid crystal is independent from variations in the off-set voltage Voff of the amplifiers 113. Namely, the voltage Vlc to be applied to liquid crystal remains unchanged even if there are variations in off-set voltage Voff among the amplifiers 113. The above first novel liquid crystal display operated in the above described first driving method is capable of applying a highly accurate voltage to the liquid crystal even if there are variations in off-set voltage Voff among the amplifiers 113.

The above first novel liquid crystal display device operated in the above second driving method provides further effects as follows.

It is possible to reduce the amplitude of the image signals into about one half, wherein the image signals are supplied to the data driver circuit 110.

If the liquid crystal display is driven by the conventional driving method, it is required to accomplish an alternating current driving to prevent any direct current voltage component from remaining in the voltage to be applied to the liquid crystal through plural frames so as to prevent that an electrolysis of the liquid crystal molecules is caused to generate ions in the liquid crystal molecules, whereby the generated ions generate local electric fields which displaces the intensity of the electric field applied between the pixel electrode and the column-common electrode.

In order to apply Vvcmax as a maximum voltage of the image signal into the liquid crystal, the separate column-common electrode 144 is fixed in potential at Vcom, whilst the voltage in the range of (−Vvcmax+Vcom) to (+Vvcmax+Vcom).

The maximum value of the amplitude of the image signals is 2×Vvcmax. It is also required that the range of amplitude of the amplifiers 113 in the data driver circuit 110 is over the above maximum value.

By contrast to the conventional driving method, if the liquid crystal display device is driven by the second novel driving method, then the amplitude of the image signal with the negative polarity to the separate column-common electrode potential is ranged from (−Vvcmax+Vcomh) to (Vcomh), whilst the amplitude of the image signal with the positive polarity to the separate column-common electrode potential is ranged from (Vcomh) to (Vvcmax+Vcomh).

If Vcomh=Vcoml+Vvcmax, the voltage range to be inputted into the amplifiers 113 are independent from the negative and positive polarities and are ranged from Vcoml to (Vvcmax+Vcoml), and the maximum amplitude is Vvcmax.

In accordance with the above second driving method, it is possible to reduce the amplitude of the image signals to be supplied to the data driver circuit 110 into about one half so that the required performances of the amplifiers are relaxed. Further, operational voltages necessary for the data driver circuit 110 is also reduced into about one half, whereby the power consumption of the liquid crystal display device is also reduced.

Figure 7:
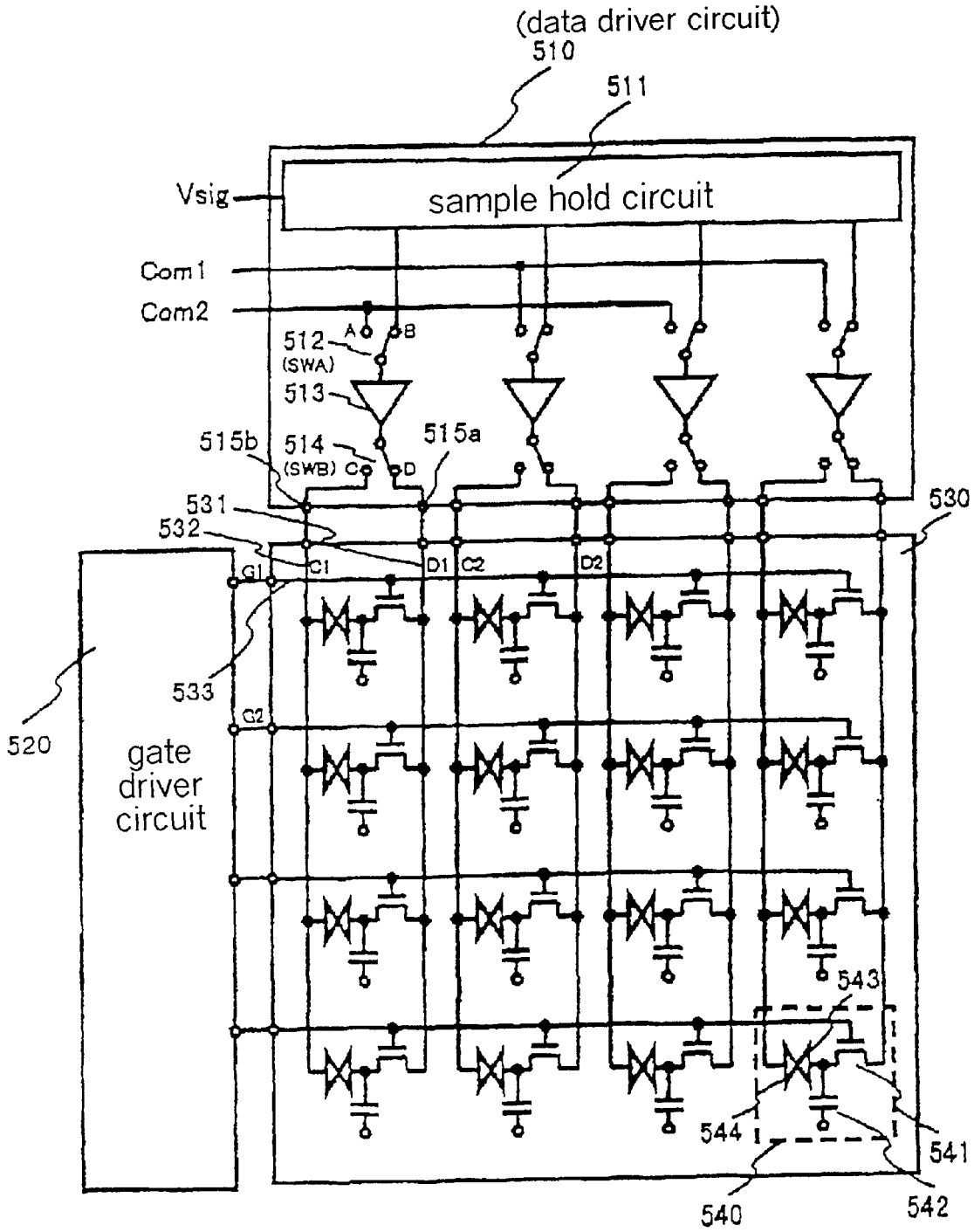
FIG. 7 is a circuit diagram illustrative of an equivalent circuit of a second novel in-plane switching mode active material liquid crystal display device in a second embodiment in accordance with the present invention.

A second embodiment according to the present invention will be described in detail with reference to the drawings. FIG. 7 is a circuit diagram illustrative of an equivalent circuit of a second novel in-plane switching mode active material liquid crystal display device in a second embodiment in accordance with the present invention.

The second novel in-plane switching mode active material liquid crystal display device comprises a data driver circuit 510, a gate driver circuit 520 and a liquid crystal display panel 530 which is connected to the data driver circuit 510 and the gate driver circuit 520. The liquid crystal display panel 530 has an array of pixels 540 which are aligned in matrix throughout the liquid crystal display panel 530. The liquid crystal display panel 530 also has a plurality of data lines 531 which extend in parallel to each other in a column direction for transmission of data to the pixels 540. The data lines 531 are connected to the data driver circuit 510. The liquid crystal display panel 530 also has a plurality of gate lines 533 which extend in parallel to each other but in a row direction perpendicular to the column direction along which the data lines 531 extend. The gate lines 533 are provided for transmission of gate control signals to the pixels 540. The gate lines 533 are connected to the gate driver circuit 520. The pixels 540 are positioned at crossing points of the data lines 531 and the gate lines 533. The liquid crystal display panel 530 also has a plurality of separate column-common electrode lines 532 which extend in parallel to each other but in the column direction perpendicular to the row direction along which the gate lines 533 extend. The separate column-common electrode lines 532 are provided for every column alignments of the pixels 540, so that one of the separate column-common electrode lines 532 is provided for corresponding one column alignment of the pixels 540.

Each of the pixels 540 is represented by a square-shaped broken line in FIG. 7. Each of the pixels 540 further comprises a pixel transistor 541, a storage capacitor 542, a pixel electrode 543 and a column-common electrode 544. The pixel transistor 541 comprises a thin film transistor formed in a substrate. The pixel transistor 541 may comprise either an amorphous silicon thin film transistor or a polysilicon thin film transistor. The pixel transistor 541 in each of the pixels 540 has a gate electrode which is connected to corresponding one of the gate lines 533. The pixel transistor 541 in each of the pixels 540 has a source electrode which is connected to corresponding one of the data lines 531. The storage capacitor 542 is connected between a drain electrode of the pixel transistor 541 and a ground line. The pixel electrode 543 in each of the pixels 540 is connected to the drain electrode of the pixel transistor 541. The column-common electrode 544 in each of the pixels 540 is connected to corresponding one of the separate column-common electrode lines 532, so that a separately controlled column-common electrode voltage may be applied through the corresponding one of the separate column-common electrode lines 532 to the column-common electrode 544 of the pixels 540. The data lines 531 are driven by the data driver circuit 510. The gate lines 533 are driven by the gate driver circuit 520.

The data driver circuit 510 has a sample hold circuit 511, a plurality of first switches 512 provided for every columns of the pixels, a plurality of amplifiers 513 provided for every columns of the pixels, a plurality of second switches 514 provided for every columns of the pixels, plural pairs of an image signal output terminal 515*a* and a column-common voltage output terminal 515*b*. The sample hold circuit 511 is provided for sampling and holding image signals for one horizontal time period. Each of the plural first switches 512 is provided between the sample hold circuit 511 and corresponding one of the plural amplifiers 513. Each of the first switches 512 has a fixing terminal connected to an input terminal of the corresponding one of the amplifiers 513 and first and second switching terminals "A" and "B". The first switching terminal is connected to dual. panel-common lines "Com1" and "Com2" extending in a row direction. The first switches 512 aligned in the odd numbers from the most left end are connected through the first switching terminals "A" to the first panel-common line "Com1". The first switches 512 aligned in the even numbers from the most left end are connected through the first switching terminals "A" to the second panel-common line "Com2". The second switching terminal "B" of each of the amplifier 513 is connected to corresponding one of the output terminals of the sample hold circuit 511. Each of the first switches 512 aligned in the odd numbers from the left end is switched to connect the fixing terminal to either one of the first and second switching terminals "A" and "B" so that each of the first switches 512 aligned in the odd numbers from the left end switches in one horizontal time period to transmit either one of output voltage from the sample hold circuit 511 and a first panel-common voltage level of the first panel-common line "Com1". Each of the first switches 512 aligned in the even numbers from the left end is switched to connect the fixing terminal to either one of the first and second switching terminals "A" and "B" so that each of the first switches 512 aligned in the even numbers from the left end switches in one horizontal time period to transmit either one of output voltage from the sample hold circuit 511 and a second panel-common voltage level of the second panel-common line "Com2". Each of the amplifiers 513 has an input terminal connected to the fixing terminal of the first switch 512 for receiving and amplifying selected one of the output voltage from the sample hold circuit 511 and the first or second panel-common voltage level of the first or second panel-common line "Com1" or "Com2". The second switch 514 is provided between the amplifier 513 and both corresponding one of the separated column-common electrode lines 532 and the corresponding data line 531 in the display panel 530. The second switch 514 has a fixing terminal connected to an output terminal of the amplifier 513 for receiving the amplified one of the output voltage from the sample hold circuit 511 and the first or second panel-common voltage level of the first or second panel-common line "Com1" or "Com2". The second switch 514 has a first switching terminal "C" connected to corresponding one of the separate column-common electrode lines 532 provided for every columns of the pixels in the display panel. The second switch 514 has a second switching terminal "D" connected to corresponding one of the data lines 531 provided for every columns of the pixels in the display panel. The first switching terminal "C" of the second switch 514 is connected to the column-common voltage output terminal 515*b* of the data driver circuit 511. The column-common voltage output terminal 515*b* is also connected to corresponding one of the corresponding one of the separate column-common electrode lines 532. The second switching terminal "D" of the second switch 514 is connected to the image signal output terminal 515*a* of the data driver circuit 511. The image signal output terminal 515*a* is also connected to corresponding one of the data lines 531. Each of the second switches 514 is switched to connect the fixing terminal to either one of the first and second switching terminals "C" and "D" so that each of the second switches 514 switches in one horizontal time period to either transmit the amplified image signal voltage to the data line 531 or transmit the amplified column-common electrode voltage to the corresponding separate column-common electrode line separately provided for the column. Namely, the first and second switches 512 and 514 are co-operated with each other so that, in one horizontal time period, the first switch 512 connects the fixing terminal and the first switching terminal "A" and the second switch 514 connects the fixing terminal and the first switching terminal "C" so as to connect the dual panel-common lines "Com1" and "Com2" to the separated column-common electrode line 532 through the first and second switches 512 and 514 and the amplifier 513, whereby to transmit the amplified column-common voltage onto the separated column-common electrode line 532, and thus in the next horizontal time period, the first switch 512 switches to connect the fixing terminal and the second switching terminal "B" and the second switch 514 also switches to connect the fixing terminal and the first switching terminal "D" so as to connect the output terminal of the sample hold circuit 511 to the data line 531 through the first and second switches 512 and 514 and the amplifier 513, whereby to transmit the amplified image signal voltage onto the data line 531.

As described above, in accordance with the second novel in plane switching mode active matrix liquid crystal display device, the column-common electrode lines are separately provided for every columns for receiving column-common electrode voltages individually amplified by the amplifiers which serve to amplify the image signals for transmission thereof onto the counterpart data lines. The column-common electrode voltages individually amplified in every columns are written in horizontal blanking time periods. Namely, both the image signals to be transmitted onto the data line and the column-common voltages to be transmitted onto the counterpart separate column-common electrode line which makes the same column with the data line are amplified by the same amplifier, so that even if any variation in off set is caused between the plural amplifiers, it is possible to cause a highly accurate potential difference between the pixel electrode applied with the image signal having been transmitted on the data line and the separate column-common electrode applied with the individual column-common voltage having been transmitted on the separate column-common electrode line, whereby an electric field with an highly accurate intensity is applied across the liquid crystal between the pixel electrode and the column-common electrode in each of the pixels.

The display panel is driven by an alternate current driving method, wherein the voltage to be applied across the liquid crystal between the pixel electrode and the column-common electrode is inverted or changed in polarity for every frames. Further, different column-common voltage levels are applied to the column-common electrode between a first frame in applying a positive polarity voltage to the pixel electrode and a second frame in applying a negative polarity voltage to the pixel electrode, so as to allow that an amplitude in voltage level of the image signals to be applied to the pixel electrode is reduced into about one half of that necessary when a fixed column-common voltage level remains applied to the column-common electrode between the first and second frames. This reduction in the necessary amplitude in voltage level of the image signals by applying the different column-common voltage levels to the column-common electrode between the first and second frames allows relaxing operational conditions of the amplifiers, namely makes it easy to design the amplifiers.

The following descriptions will focus on the operations of the above display device.

Figure 8:
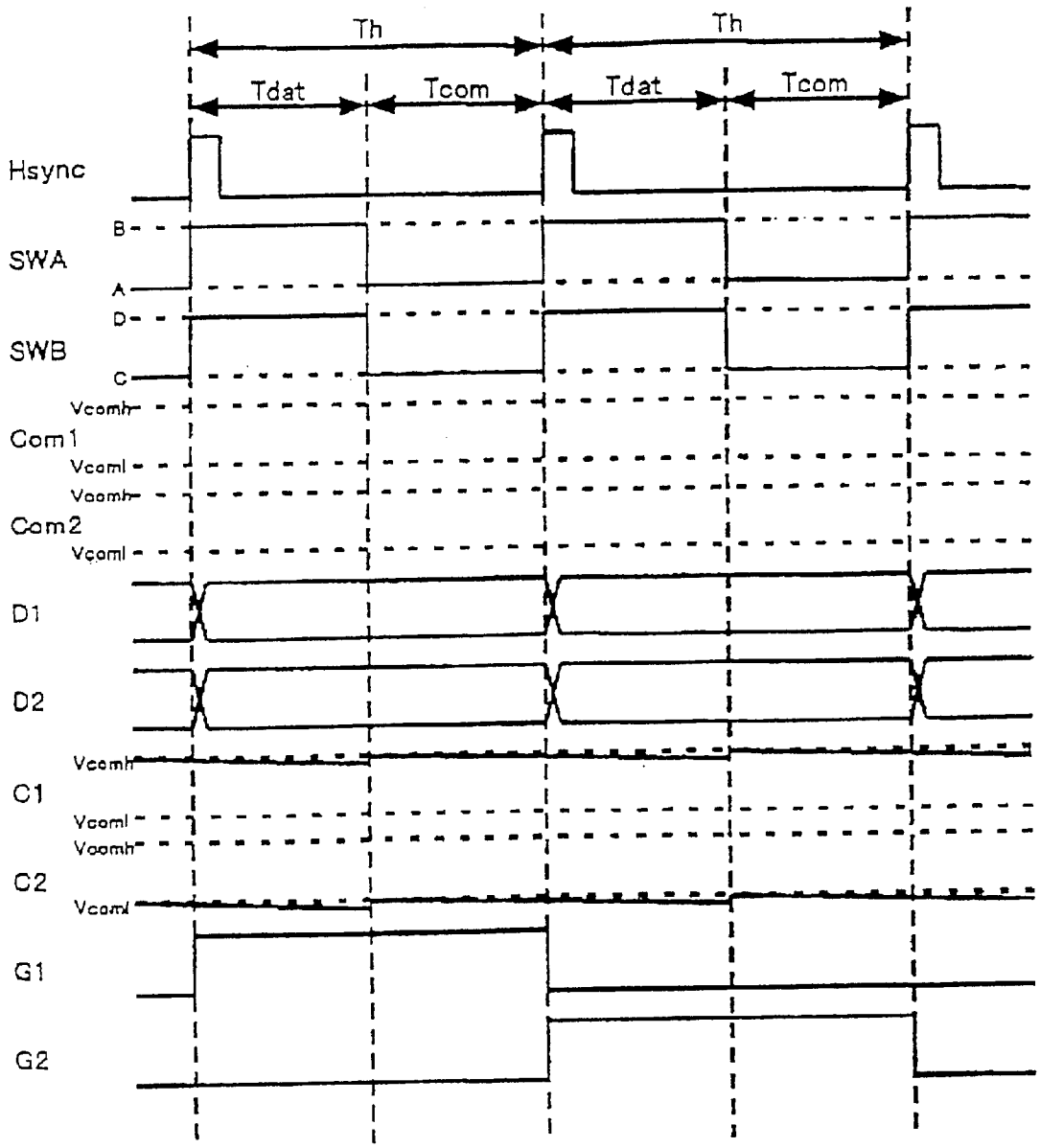
FIG. 8 is a timing chart illustrative of waveforms in even frames of a horizontal synchronizing signal Hsync, first and second panel-common electrode potentials Com1 and Com2, a first data line potential D1 of first one of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the second novel in-plane switching mode active material liquid crystal display device of FIG. 7.
Figure 9:
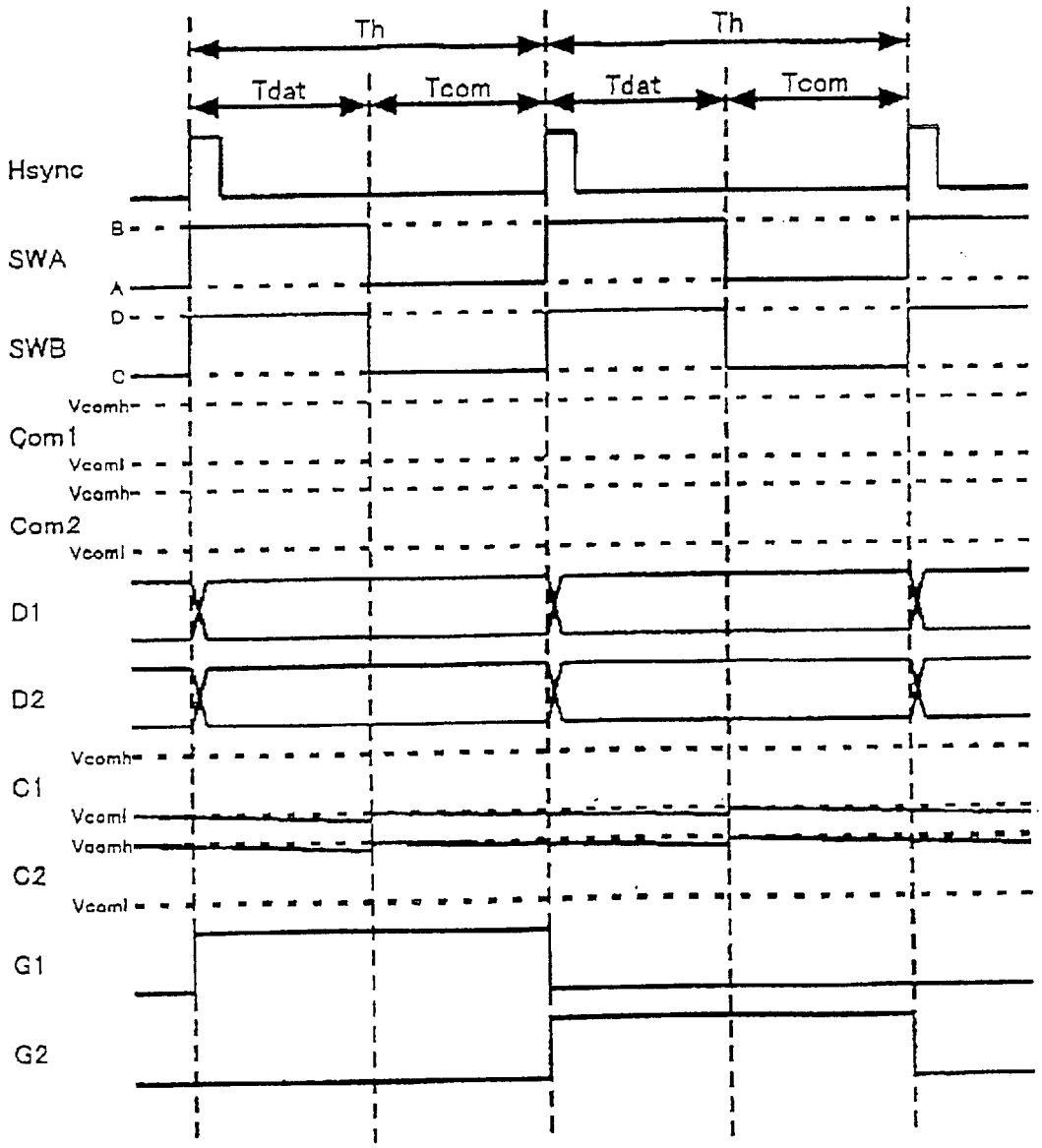
FIG. 9 is a timing chart illustrative of waveforms in odd frames of a horizontal synchronizing signal Hsync, first and second panel-common electrode potentials Com1 and Com2, a first data line potential D1 of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the second novel in-plane switching mode active material liquid crystal display device of FIG. 7.

FIG. 8 is a timing chart illustrative of waveforms in even frames of a horizontal synchronizing signal Hsync, first and second panel-common electrode potentials Com1 and Com2, a first data line potential D1 of first one of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the second novel in-plane switching mode active material liquid crystal display device of FIG. 7. FIG. 9 is a timing chart illustrative of waveforms in odd frames of a horizontal synchronizing signal Hsync, first and second panel-common electrode potentials Com1 and Com2, a first data line potential D1 of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the second novel in-plane switching mode active material liquid crystal display device of FIG. 7.

With reference to FIG. 8, in the even frames, image signals to be written through the even number data lines into the pixel electrodes 543 have negative polarity to the separate column-common voltages to be applied to the separate column-common electrodes 544, whilst image signals to be written through the odd number data lines into the pixel electrodes 543 have positive polarity to the separate column-common voltages to be applied to the separate column-common electrodes 544. Images signals Vsig are supplied to the data driver circuit 510. The odd number data lines are applied with a voltage (Vvd+Vcomh), whilst the even number data lines are applied with a voltage (−Vvd+Vcomh) in order to apply the voltage Vvd to the liquid crystal between the separate column-common electrodes 544 and the pixel electrodes 543. The first panel-common line Com1 is applied with a first panel-common voltage level Vcomh, whilst the second panel-common line Com2 is applied with a second panel-common voltage level Vcoml.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "dat", the data driver circuit 510 operates as follows. Each of the first switches 512 switches to connect the fixing terminal and the second switching terminal "B" so as to connect the input terminal of the amplifiers 513 to the sample hold circuit 511. Each of the second switches 514 switches to connect the fixing terminal and the second switching terminal "D" so as to connect the output terminal of the amplifiers 513 to the image signal output terminal 515*a* which is connected to the data line 531. Image signals held in the sample hold circuit 511 are transmitted through the amplifiers 513 into the data lines 531

In the second half period "Tcom", the data driver circuit 510 operates as follows. Each of the first switches 512 switches to connect the fixing terminal and the first switching terminal "A" so as to connect the input terminal of the amplifiers 513 to the first and second panel-common lines "Com1" and "Com2". Each of the second switches 514 switches to connect the fixing terminal and the first switching terminal "C" so as to connect the output terminal of the amplifiers 513 to the column-common voltage output terminal 515*b* which is connected to the separate column-common electrode line 532. The first panel-common voltage Vcomh of the first panel-common line "Com1" is transmitted through the amplifier 513 to the even number separate column-common electrode line 532 aligned in the even numbers from the left end. The second panel-common voltage Vcoml of the second panel-common line "Com2" is transmitted through the amplifier 513 to the odd number separate column-common electrode line 532 aligned in the odd numbers from the left end.

Each of the data lines 531 and the separate column-common electrode line 532 has a parasitic capacitance which is caused by the fact that each of the data lines 531 and the separate column-common electrode line 532 extends to cross over the gate lines 533. The data line 531 and the separate column-common electrode line 532 hold the voltages one charged by the previous switching operations.

If, in this horizontal time period, the gate line "G1" has a high level potential to place the pixel transistor 541 into ON-state, the image signal on the data line 531 is transmitted through the pixel transistor 541 into the pixel electrode 543 of the pixel capacitance and also into the storage capacitance 542, whereby the pixel capacitance and the storage capacitance 542 are charged in accordance with the image signal voltage level.

In the next horizontal time period, the data driver circuit 510 operates as follows. In the first half period "Tdat", each of the first switches 512 switches to connect the fixing terminal and the second switching terminal "B" so as to connect the input terminal of the amplifiers 513 to the sample hold circuit 511. Each of the second switches 514 switches to connect the fixing terminal and the second switching terminal "D" so as to connect the output terminal of the amplifiers 513 to the image signal output terminal 515*a* which is connected to the data line 531. Image signals held in the sample hold circuit 511 are transmitted through the amplifiers 513 into the data lines 531.

In the second half period "Tcom", the data driver circuit 510 operates as follows. Each of the first switches 512 switches to connect the fixing terminal and the first switching terminal "A" so as to connect the input terminal of the amplifiers 513 to the single panel-common line "Com". Each of the second switches 514 switches to connect the fixing terminal and the first switching terminal "C" so as to connect the output terminal of the amplifiers 513 to the column-common voltage output terminal 515*b* which is connected to the separate column-common electrode line 532. The first common voltage Vcomh of the first panel-common line "Com1" is transmitted through the amplifier 513 to the even number separate column-common electrode lines 532 align in the even number from the left end. The second common voltage Vcoml of the second panel-common line "Com2" is transmitted through the amplifier 513 to the odd number separate column-common electrode lines 532 align in the odd number from the left end.

Each of the data lines 531 and the separate column-common electrode line 532 has a parasitic capacitance which is caused by the fact that each of the data lines 531 and the separate column-common electrode line 532 extends to cross over the gate lines 533. The data line 531 and the separate column-common electrode line 532 hold the voltages one charged by the previous switching operations.

If, in this horizontal time period, the gate line "G2" has a high level potential to place the pixel transistor 541 into ON-state, the image signal on the data line 531 is transmitted through the pixel transistor 541 into the pixel electrode 543 of the pixel capacitance and also into the storage capacitance 542, whereby the pixel capacitance and the storage capacitance 542 are charged in accordance with the image signal voltage level.

The above operations are repeated for all of the gate lines G1, - - - Gm, so that image signals are written into all of the pixels.

With reference to FIG. 9, in odd frames, image signals to be written through the odd number data lines into the pixel electrodes 543 have negative polarity to the separate column-common voltages to be applied to the separate column-common electrodes 544, whilst image signals to be written through the even number data lines into the pixel electrodes 543 have positive polarity to the separate column-common voltages to be applied to the separate column-common electrodes 544. Images signals Vsig are supplied to the data driver circuit 510. The even number data lines are applied with a voltage (Vvd+Vcomh), whilst the odd number data lines are applied with a voltage (−Vvd+Vcomh) in order to apply the voltage Vvd to the liquid crystal between the separate column-common electrodes 544 and the pixel electrodes 543. The first panel-common line Com1 is applied with a first panel-common voltage level Vcomh, whilst the second panel-common line Com2 is applied with a second panel-common voltage level Vcoml.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 510 operates as follows. Each of the first switches 512 switches to connect the fixing terminal and the second switching terminal "B" so as to connect the input terminal of the amplifiers 513 to the sample hold circuit 511. Each of the second switches 514 switches to connect the fixing terminal and the second switching terminal "D" so as to connect the output terminal of the amplifiers 513 to the image signal output terminal 515*a* which is connected to the data line 531. Image signals held in the sample hold circuit 511 are transmitted through the amplifiers 513 into the data lines 531.

In the second half period "Tcom", the data driver circuit 510 operates as follows. Each of the first switches 512 switches to connect the fixing terminal and the first switching terminal "A" so as to connect the input terminal of the amplifiers 513 to the single panel-common line "Com". Each of the second switches 514 switches to connect the fixing terminal and the first switching terminal "C" so as to connect the output terminal of the amplifiers 513 to the column-common voltage output terminal 515*b* which is connected to the separate column-common electrode line 532. The first panel-common voltage Vcomh of the first panel-common line "Com1" is transmitted through the even number amplifier 513 to the even number separate column-common electrode lines 532. The second panel-common voltage Vcoml of the second panel-common line "Com2" is transmitted through the odd number amplifier 513 to the odd number separate column-common electrode lines 532.

Each of the data lines 531 and the separate column-common electrode line 532 has a parasitic capacitance which is caused by the fact that each of the data lines 531 and the separate column-common electrode line 532 extends to cross over the gate lines 533. The data line 531 and the separate column-common electrode line 532 hold the voltages one charged by the previous switching operations.

If, in this horizontal time period, the gate line "G1" has a high level potential to place the pixel transistor 541 into ON-state, the image signal on the data line 531 is transmitted through the pixel transistor 541 into the pixel electrode 543 of the pixel capacitance and also into the storage capacitance 542, whereby the pixel capacitance and the storage capacitance 542 are charged in accordance with the image signal voltage level.

In the next horizontal time period, the data driver circuit 510 operates as follows. In the first half period "Tdat", each of the first switches 512 switches to connect the fixing terminal and the second switching terminal "B" so as to connect the input terminal of the amplifiers 513 to the sample hold circuit 511. Each of the second switches 514 switches to connect the fixing terminal and the second switching terminal "D" so as to connect the output terminal of the amplifiers 513 to the image signal output terminal 515*a* which is connected to the data line 531. Image signals held in the sample hold circuit 511 are transmitted through the amplifiers 513 into the data lines 531.

In the second half period "Tcom", the data driver circuit 510 operates as follows. Each of the first switches 512 switches to connect the fixing terminal and the first switching terminal "A" so as to connect the input terminal of the amplifiers 513 to the single panel-common line "Com". Each of the second switches 514 switches to connect the fixing terminal and the first switching terminal "C" so as to connect the output terminal of the amplifiers 513 to the column-common voltage output terminal 515*b* which is connected to the separate column-common electrode line 532. The first common voltage Vcomh of the first panel-common lines "Com1" is transmitted through the even number amplifiers 513 to the even number separate column-common electrode lines 532. The second common voltage Vcoml of the second panel-common lines "Com2" is transmitted through the odd number amplifiers 513 to the odd number separate column-common electrode lines 532.

Each of the data lines 531 and the separate column-common electrode line 532 has a parasitic capacitance which is caused by the fact that each of the data lines 531 and the separate column-common electrode line 532 extends to cross over the gate lines 533. The data line 531 and the separate column-common electrode line 532 hold the voltages one charged by the previous switching operations.

If, in this horizontal time period, the gate line "G2" has a high level potential to place the pixel transistor 541 into ON-state, the image signal on the data line 531 is transmitted through the pixel transistor 541 into the pixel electrode 543 of the pixel capacitance and also into the storage capacitance 542, whereby the pixel capacitance and the storage capacitance 542 are charged in accordance with the image signal voltage level.

The above operations are repeated for all of the gate lines G1, - - - Gm, so that image signals are written into all of the pixels.

The negative voltage −Vlc to be applied in the even frames to the liquid crystal between the even number pixel electrodes 543 and the even number separate column-common electrodes 544 corresponds to a potential difference between the even number pixel electrode 543 and the even number separate column-common electrode 544. The negative voltage −Vlc to be applied in the even frames to the even number liquid crystal is given by the following equation (7)

$$\begin{aligned} Vlc &= Vsig - Vcomh \\ &= (-Vvd + Vcomh) - Vcomh \\ &= -Vvd \end{aligned} \tag{7}$$

Further, the positive voltage Vlc to be applied in the odd frames to the odd number liquid crystal between the odd number pixel electrodes 543 and the odd number separate column-common electrodes 544 corresponds to a potential difference between the odd number pixel electrode 543 and the odd number separate column-common electrode 544. The positive voltage Vlc to be applied in the odd frames to the odd number liquid crystal is given by the following equation (8)

$$\begin{aligned} Vlc &= Vsig - Vcoml \\ &= (Vvd + Vcoml) - Vcoml \\ &= Vvd \end{aligned} \tag{8}$$

In accordance with the third novel driving method, in the even frame, the image signals with the negative polarity with reference to the even number separate column-common electrode lines are written into the even number pixel electrodes, whilst the image signals with the positive polarity with reference to the odd number separate column-common electrode lines are written into the odd number pixel electrodes. In the odd frame, the image signals with the positive polarity with reference to the even number separate column-common electrode lines are written into the even number pixel electrodes, whilst the image signals with the negative polarity with reference to the odd number separate column-common electrode lines are written into the odd number pixel electrodes.

The above second novel liquid crystal display device operated in the above third driving method provides the following effects.

The data driver circuit 510 has the same number of or a larger number of the amplifiers 513 than the data lines 531 of the display panel 530. It is assumed that there are variations in off-set voltage among the amplifiers 513. The output from the amplifier 513 is given by the above equation (1).

If the above liquid crystal display is driven in the above described first driving method, then the voltages given by the above equations (2) and (3) are written into the pixel electrode 543 and the separate column-common electrode 514.

A voltage Vlc to be applied to liquid crystal between the pixel electrode 543 and the separate column-common electrode 544 corresponds to a potential difference between the pixel electrode 543 and the separate column-common electrode 544, for which reason the voltage Vlc to be applied to liquid crystal may be represented by the above equation (4).

The above equation (4) means that the voltage Vlc to be applied to liquid crystal is independent from the off-set voltage Voff of the amplifier 513. Accordingly, the voltage Vlc to be applied to liquid crystal is independent from variations in the off-set voltage Voff of the amplifiers 513. Namely, the voltage Vlc to be applied to liquid crystal remains unchanged even if there are variations in off-set voltage Voff among the amplifiers 513. The above second novel liquid crystal display operated in the above described first driving method is capable of applying a highly accurate voltage to the liquid crystal even if there are variations in off-set voltage Voff among the amplifiers 513.

The above second novel liquid crystal display device operated in the above second driving method provides further effects as follows.

It is possible to reduce the amplitude of the image signals into about one half, wherein the image signals are supplied to the data driver circuit 510.

If the liquid crystal display is driven by the conventional driving method, it is required to accomplish an alternating current driving to prevent any direct current voltage component from remaining in the voltage to be applied to the liquid crystal through plural frames so as to prevent that an electrolysis of the liquid crystal molecules is caused to generate ions in the liquid crystal molecules, whereby the generated ions generate local electric fields which displaces the intensity of the electric field applied between the pixel electrode and the column-common electrode.

In order to apply Vvcmax as a maximum voltage of the image signal into the liquid crystal, the separate column-common electrode 544 is fixed in potential at Vcom, whilst the voltage in the range of (−Vvcmax+Vcom) to (+Vvcmax+Vcom).

The maximum value of the amplitude of the image signals is 2×Vvcmax. It is also required that the range of amplitude of the amplifiers 513 in the data driver circuit 510 is over the above maximum value.

By contrast to the conventional driving method, if the liquid crystal display device is driven by the second novel driving method, then the amplitude of the image signal with the negative polarity to the separate column-common electrode potential is ranged from (−Vvcmax+Vcomh) to (Vcomh), whilst the amplitude of the image signal with the positive polarity to the separate column-common electrode potential is ranged from (Vcomh) to (Vvcmax+Vcomh).

If Vcomh=Vcoml+Vvcmax, the voltage range to be inputted into the amplifiers 513 are independent from the negative and positive polarities and are ranged from Vcoml to (Vvcmax+Vcoml), and the maximum amplitude is Vvcmax.

In accordance with the above second driving method, it is possible to reduce the amplitude of the image signals to be supplied to the data driver circuit 510 into about one half so that the required performances of the amplifiers are relaxed. Further, operational voltages necessary for the data driver circuit 510 is also reduced into about one half, whereby the power consumption of the liquid crystal display device is also reduced, The above second novel liquid crystal display device operated in the above second driving method provides further more effects as follows.

The polarities of the image signals to be applied to the pixels connected to the even number data lines and the odd number data lines are inverted between in the even frames and the odd frames. For example, in the even frame, the image signals with the negative polarity with reference to the even number separate column-common electrode lines are written into the even number pixel electrodes, whilst the image signals with the positive polarity with reference to the odd number separate column-common electrode lines are written into the odd number pixel electrodes. In the odd frame, the image signals with the positive polarity with reference to the even number separate column-common electrode lines are written into the even number pixel electrodes, whilst the image signals with the negative polarity with reference to the odd number separate column-common electrode lines are written into the odd number pixel electrodes. This alternating driving method reduces a flicker of the display.

The primary reason for causing the flicker is as follows. A filed through voltage caused by turning ON and OFF of the pixel transistor is different dependent upon the polarity of the pixel voltage to be applied to the pixel electrode, wherein the polarity of the pixel voltage is decided with reference to the common electrode. The difference in the field through voltage causes that the actually applied voltage to the liquid crystal is lightly different from the potential written onto the data line, for which reason even if the same image signals are written into the liquid crystal, the flicker is caused by a slight difference in light transmittance of the liquid crystal. However, in accordance with the present invention, in each frame, almost the same number of the pixels are applied with the image signals with the positive and negative polarities with reference to the common electrode potential, an influence of the flicker is substantially cancelled. Namely, the flicker is reduced.

Figure 10:
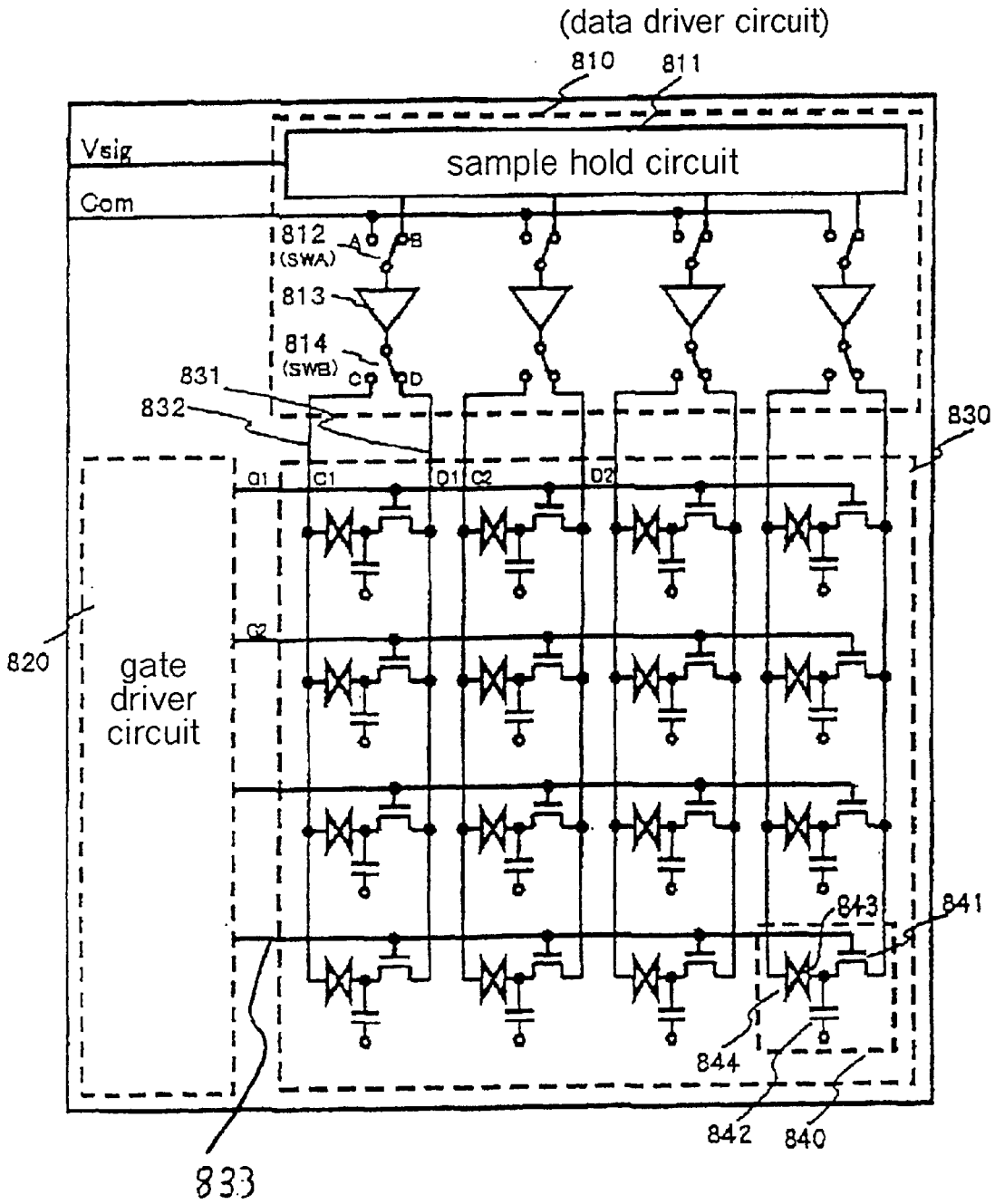
FIG. 10 is a circuit diagram illustrative of an equivalent circuit of a third novel in-plane switching mode active material liquid crystal display device in a third embodiment in accordance with the present invention.

A third embodiment according to the present invention will be described in detail with reference to the drawings. FIG. 10 is a circuit diagram illustrative of an equivalent circuit of a third novel in-plane switching mode active material liquid crystal display device in a third embodiment in accordance with the present invention.

The third novel in-plane switching mode active material liquid crystal display device comprises a data driver circuit 810, a gate driver circuit 820 and a liquid crystal display panel 830 which is connected to the data driver circuit 810 and the gate driver circuit 820. The data driver circuit 810, the gate driver circuit 820 and the liquid crystal display panel 830 are unitary formed as shown in FIG. 10. The liquid crystal display panel 830 has an array of pixels 840 which are aligned in matrix throughout the liquid crystal display panel 830. The liquid crystal display panel 830 also has a plurality of data lines 831 which extend in parallel to each other in a column direction for transmission of data to the pixels 840. The data lines 831 are connected to the data driver circuit 810. The liquid crystal display panel 830 also has a plurality of gate lines 833 which extend in parallel to each other but in a row direction perpendicular to the column direction along which the data lines 831 extend. The gate lines 833 are provided for transmission of gate control signals to the pixels 840. The gate lines 833 are connected to the gate driver circuit 820. The pixels 840 are positioned at crossing points of the data lines 831 and the gate lines 833. The liquid crystal display panel 830 also has a plurality of separate column-common electrode lines 832 which extend in parallel to each other but in the column direction perpendicular to the row direction along which the gate lines 833 extend. The separate column-common electrode lines 832 are provided for every column alignments of the pixels 840, so that one of the separate column-common electrode lines 832 is provided for corresponding one column alignment of the pixels 840.

Each of the pixels 840 is represented by a square-shaped broken line in FIG. 10. Each of the pixels 840 further comprises a pixel transistor 841, a storage capacitor 842, a pixel electrode 843 and a column-common electrode 844. The pixel transistor 841 comprises a thin film transistor formed in a substrate. The pixel transistor 841 may comprise either an amorphous silicon thin film transistor or a polysilicon thin film transistor. The pixel transistor 841 in each of the pixels 840 has a gate electrode which is connected to corresponding one of the gate lines 833. The pixel transistor 841 in each of the pixels 840 has a source electrode which is connected to corresponding one of the data lines 831. The storage capacitor 842 is connected between a drain electrode of the pixel transistor 841 and a ground line. The pixel electrode 843 in each of the pixels 840 is connected to the drain electrode of the pixel transistor 841. The column-common electrode 844 in each of the pixels 840 is connected to corresponding one of the separate column-common electrode lines 832, so that a separately controlled column-common electrode voltage may be applied through the corresponding one of the separate column-common electrode lines 832 to the column-common electrode 844 of the pixels 840. The data lines 831 are driven by the data driver circuit 810. The gate lines 833 are driven by the gate driver circuit 820.

The data driver circuit 810 has a sample hold circuit 811, a plurality of first switches 812 provided for every columns of the pixels, a plurality of amplifiers 813 provided for every columns of the pixels, a plurality of second switches 814 provided for every columns of the pixels, plural pairs of an image signal output terminal 115*a* and a column-common voltage output terminal 115*b*. The sample hold circuit 811 is provided for sampling and holding image signals for one horizontal time period. Each of the plural first switches 812 is provided between the sample hold circuit 811 and corresponding one of the plural amplifiers 813. Each of the first terminals "A" and "B". The first switching terminal is connected to a single panel-common line "Com" extending in a row direction. All of the first switches 812 are connected through the first switching terminals "A" to the single panel-comnmon line "Com". The second switching terminal "B" is connected to corresponding one of the output terminals of the sample hold circuit 811. Each of the first switches 812 is switched to connect the fixing terminal to either one of the first and second switching terminals "A" and "B" so that each of the first switches 812 switches in one horizontal time period to transmit either one of output voltage from the sample hold circuit 811 and a panel-common voltage level of the single panel-common line "Com". Each of the amplifiers 813 has an input terminal connected to the fixing terminal of the first switch 812 for receiving and amplifying selected one of the output voltage from the sample hold circuit 811 and a panel-common voltage level of the single panel-common line "Com". The second switch 814 is provided between the amplifier 813 and both corresponding one of the separated column-common electrode lines 832 and the corresponding data line 831 in the display panel 830. The second switch 814 has a fixing terminal connected to an output terminal of the amplifier 813 for receiving the amplified one of the output voltage from the sample hold circuit 811 and a panel-common voltage level of the single panel-common line "Com". The second switch 814 has a first switching terminal "C" connected to corresponding one of the separate column-common electrode lines 832 provided for every columns of the pixels in the display panel. The second switch 814 has a second switching terminal "D" connected to corresponding one of the data lines 831 provided for every columns of the pixels in the display panel. The column-common voltage output terminal 115*b* is also connected to corresponding one of the corresponding one of the separate column-common electrode lines 832. Each of the second switches 814 is switched to connect the fixing terminal to either one of the first and second switching terminals "C" and "D" so that each of the second switches 814 switches in one horizontal time period to either transmit the amplified image signal voltage to the data line 831 or transmit the amplified column-common electrode voltage to the corresponding separate column-common electrode line separately provided for the column. Namely, the first and second switches 812 and 814 are co-operated with each other so that, in one horizontal time period, the first switch 812 connects the fixing terminal and the first switching terminal "A" and the second switch 814 connects the fixing terminal and the first switching terminal "C" so as to connect the single panel-common line "Com" to the separated column-common electrode line 832 through the first and second switches 812 and 814 and the amplifier 813, whereby to transmit the amplified column-common voltage onto the separated column-common electrode line 832, and thus in the next horizontal time period, the first switch 812 switches to connect the fixing terminal and the second switching terminal "B" and the second switch 814 also switches to connect the fixing terminal and the first switching terminal "D" so as to connect the output terminal of the sample hold circuit 811 to the data line 831 through the first and second switches 812 and 814 and the amplifier 813, whereby to transmit the amplified image signal voltage onto the data line 831.

As described above, in accordance with the third novel in plane switching mode active matrix liquid crystal display device, the column-common electrode lines are separately provided for every columns for receiving column-common electrode voltages individually amplified by the amplifiers which serve to amplify the image signals for transmission thereof onto the counterpart data lines. The column-common electrode voltages individually amplified in every columns are written in horizontal blanking time periods. Namely, both the image signals to be transmitted onto the data line and the column-common voltages to be transmitted onto the counterpart separate column-common electrode line which makes the same column with the data line are amplified by the same amplifier, so that even if any variation in off-set is caused between the plural amplifiers, it is possible to cause a highly accurate potential difference between the pixel electrode applied with the image signal having been transmitted on the data line and the separate column-common electrode applied with the individual column-common voltage having been transmitted on the separate column-common electrode line, whereby an electric field with an highly accurate intensity is applied across the liquid crystal between the pixel electrode and the column-common electrode in each of the pixels.

The display panel is driven by an alternate current driving method, wherein the voltage to be applied across the liquid crystal between the pixel electrode and the column-common electrode is inverted or changed in polarity for every frames. Further, different column-common voltage levels are applied to the column-common electrode between a first frame in applying a positive polarity voltage to the pixel electrode and a second frame in applying a negative polarity voltage to the pixel electrode, so as to allow that an amplitude in voltage level of the image signals to be applied to the pixel electrode is reduced into about one half of that necessary when a fixed column-common voltage level remains applied to the column-common electrode between the first and second frames. This reduction in the necessary amplitude in voltage level of the image signals by applying the different column-common voltage levels to the column-common electrode between the first and second frames allows relaxing operational conditions of the amplifiers, namely makes it easy to design the amplifiers.

Figure 11:
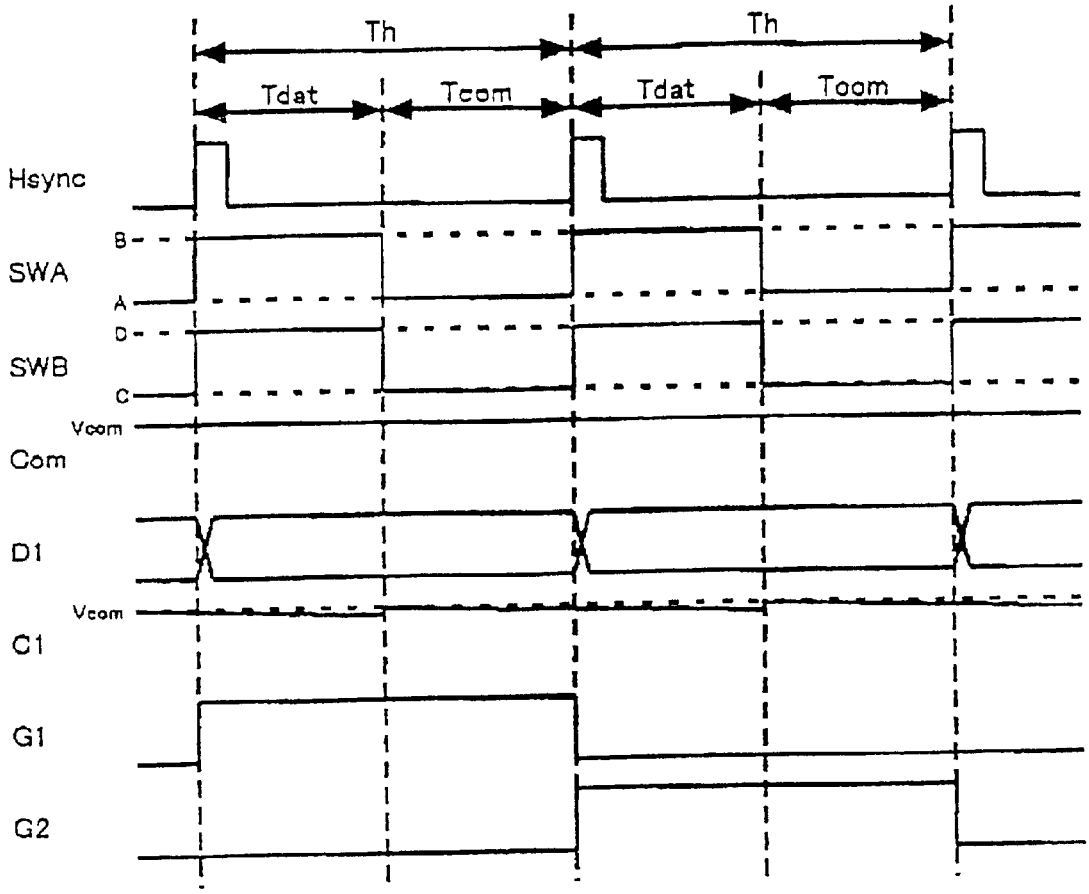
FIG. 11 is a timing chart illustrative of waveforms of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the third novel in-plane switching mode active material liquid crystal display device of FIG. 10.

The following descriptions will focus on the operations of the above display device. FIG. 11 is a timing chart illustrative of waveforms of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the third novel in-plane switching mode active material liquid crystal display device of FIG. 10.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 810 operates as follows. Each of the first switches 812 switches to connect the fixing terminal and the second switching terminal "B" so as to connect the input terminal of the amplifiers 813 to the sample hold circuit 811. Each of the second switches 814 switches to connect the fixing terminal and the second switching terminal "D" so as to connect the output terminal of the amplifiers 813 to the image signal output terminal 115*a* which is connected to the data line 831. Image signals held in the sample hold circuit 811 are transmitted through the amplifiers 813 into the data lines 831.

In the second half period "Tcom", the data driver circuit 810 operates as follows. Each of the first switches 812 switches to connect the fixing terminal and the first switching terminal "A" so as to connect the input terminal of the amplifiers 813 to the single panel-common line "Com". Each of the second switches 814 switches to connect the fixing terminal and the first switching terminal "C" so as to connect the output terminal of the amplifiers 813 to the column-common voltage output terminal 115*b* which is connected to the separate column-common electrode line 832. A common voltage Vcom of the single panel-common line "Com" is transmitted through the amplifier 813 to the separate column-common electrode line 832.

Each of the data lines 831 and the separate column-common electrode line 832 has a parasitic capacitance which is caused by the fact that each of the data lines 831 and the separate column-common electrode line 832 extends to cross over the gate lines 833. The data line 831 and the separate column-common electrode line 832 hold the voltages one charged by the previous switching operations.

If, in this horizontal time period, the gate line "G1" has a high level potential to place the pixel transistor 841 into ON-state, the image signal on the data line 831 is transmitted through the pixel transistor 841 into the pixel electrode 843 of the pixel capacitance and also into the storage capacitance 842, whereby the pixel capacitance and the storage capacitance 842 are charged in accordance with the image signal voltage level.

In the next horizontal time period, the data driver circuit 810 operates as follows. In the first half period "Tdat", each of the first switches 812 switches to connect the fixing terminal and the second switching terminal "B" so as to connect the input terminal of the amplifiers 813 to the sample hold circuit 811. Each of the second switches 814 switches to connect the fixing terminal and the second switching terminal "D" so as to connect the output terminal of the amplifiers 813 to the image signal output terminal 115*a* which is connected to the data line 831. Image signals held in the sample hold circuit 811 are transmitted through the amplifiers 813 into the data lines 831.

In the second half period "Tcom", the data driver circuit 810 operates as follows. Each of the first switches 812 switches to connect the fixing terminal and the first switching terminal "A" so as to connect the input terminal of the amplifiers 813 to the single panel-common line "Com". Each of the second switches 814 switches to connect the fixing terminal and the first switching terminal "C" so as to connect the output terminal of the amplifiers 813 to the column-common voltage output terminal 115*b* which is connected to the separate column-common electrode line 832. A common voltage Vcom of the single panel-common line "Com" is transmitted through the amplifier 813 to the separate column-common electrode line 832.

Each of the data lines 831 and the separate column-common electrode line 832 has a parasitic capacitance which is caused by the fact that each of the data lines 831 and the separate column-common electrode line 832 extends to cross over the gate lines 833. The data line 831 and the separate column-common electrode line 832 hold the voltages one charged by the previous switching operations.

If, in this horizontal time period, the gate line "G2" has a high level potential to place the pixel transistor 841 into ON-state, the image signal on the data line 831 is transmitted through the pixel transistor 841 into the pixel electrode 843 of the pixel capacitance and also into the storage capacitance 842, whereby the pixel capacitance and the storage capacitance 842 are charged in accordance with the image signal voltage level.

The above operations are repeated for all of the gate lines G1, - - - Gm, so that image signals are written into all of the pixels.

The above first novel liquid crystal display device operated in the above first driving method provides the following effects.

The data driver circuit 810 has the same number of or a larger number of the amplifiers 813 than the data lines 831 of the display panel 830. It is assumed that there are variations in off-set voltage among the amplifiers 813. The output from the amplifier 813 is given by the above equation (1).

If the above liquid crystal display is driven in the above described first driving method, then the above voltages (2) and (3) are written into the pixel electrode 843 and the separate column-common electrode 814.

A voltage Vlc to be applied to liquid crystal between the pixel electrode 843 and the separate column-common electrode 844 corresponds to a potential difference between the pixel electrode 843 and the separate column-common electrode 844, for which reason the voltage Vlc to be applied to liquid crystal may be represented by the above equation (4) using the above equations (2) and (3).

The equation (4) means that the voltage Vlc to be applied to liquid crystal is independent from the offset voltage Voff of the amplifier 813. Accordingly, the voltage Vlc to be applied to liquid crystal is independent from variations in the off-set voltage Voff of the amplifiers 813. Namely, the voltage Vlc to be applied to liquid crystal remains unchanged even if there are variations in off-set voltage Voff among the amplifiers 813. The above first novel liquid crystal display operated in the above described first driving method is capable of applying a highly accurate voltage to the liquid crystal even if there are variations in off-set voltage Voff among the amplifiers 813.

Figure 12:
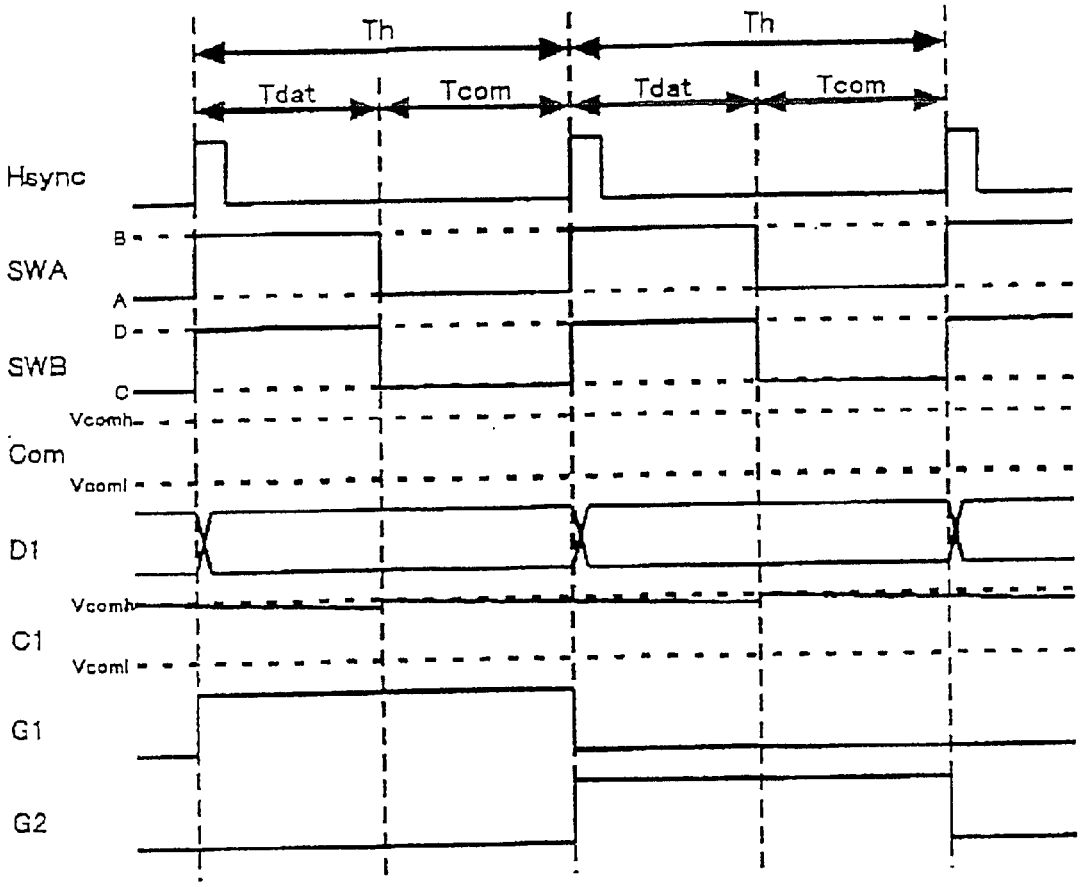
FIG. 12 is a timing chart illustrative of waveforms in even frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the third novel in-plane switching mode active material liquid crystal display device of FIG. 10.
Figure 13:
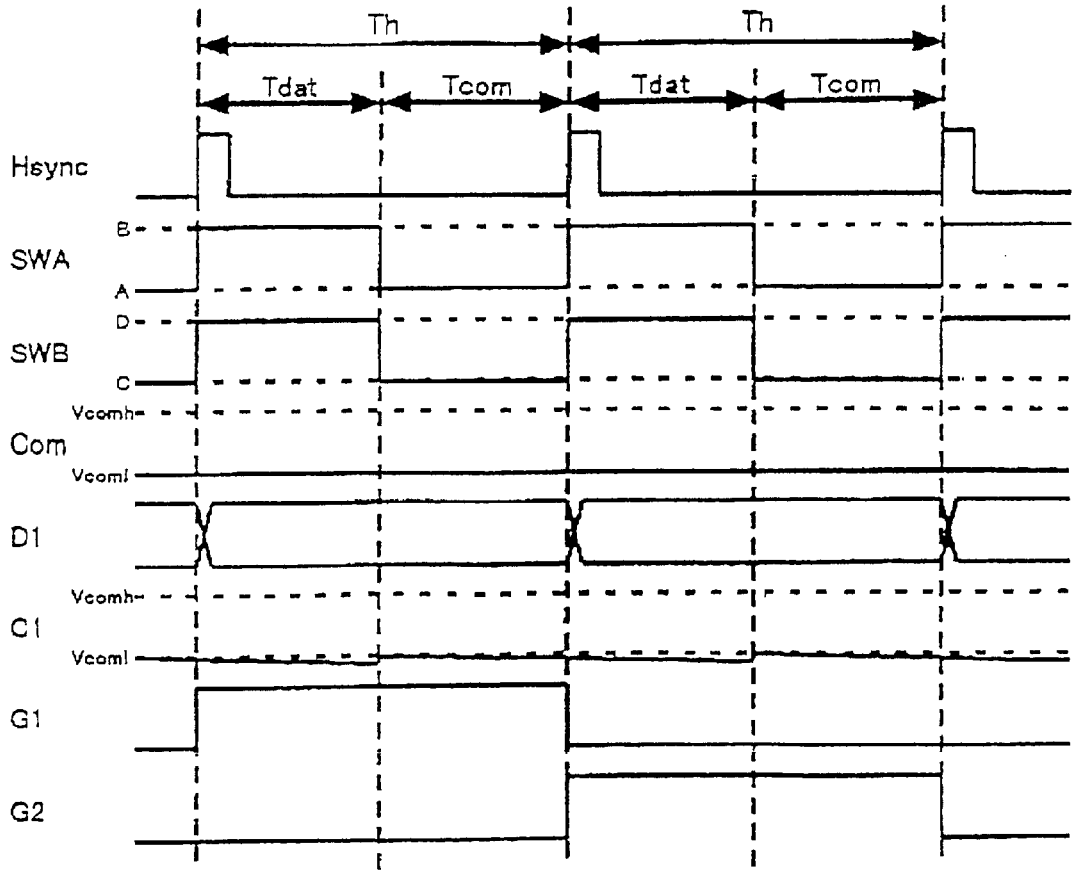
FIG. 13 is a timing chart illustrative of waveforms in odd frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the third novel in-plane switching mode active material liquid crystal display device of FIG. 10.

The above first novel liquid crystal display device may be driven by the following second novel driving method. FIG. 12 is a timing chart illustrative of waveforms in even frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the third novel in-plane switching mode active material liquid crystal display device of FIG. 10. FIG. 13 is a timing chart illustrative of waveforms in odd frames of a horizontal synchronizing signal Hsync, a panel-common electrode potential Com, a first data line potential D1 of first one of adjacent two data lines, a second data line potential D2 of second one of the adjacent two data lines, a first gate line potential G1 of first one of adjacent two gate lines, and a second gate line potential G2 of second one of the adjacent two gate lines to explain the driving method of the third novel in-plane switching mode active material liquid crystal display device of FIG. 10.

With reference to FIG. 12, image signals to be written into the pixel electrodes 843 have negative polarity to the separate column-common voltages to be applied to the separate column-common electrodes 844. Images signals Vsig are supplied to the data driver circuit 810. The separate column-common electrodes 844 is applied with a voltage Vcomh and the date driver circuit 810 is applied with a voltage (−Vvd+Vcomh) in order to apply the voltage Vvd to the liquid crystal between the separate column-common electrodes 844 and the pixel electrodes 843.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 810 operates as follows. Each of the first switches 812 switches to connect the fixing terminal and the second switching terminal "B" so as to connect the input terminal of the amplifiers 813 to the sample hold circuit 811. Each of the second switches 814 switches to connect the fixing terminal and the second switching terminal "D" so as to connect the output terminal of the amplifiers 813 to the image signal output terminal 115*a* which is connected to the data line 831. Image signals held in the sample hold circuit 811 are transmitted through the amplifiers 813 into the data lines 831.

In the second half period "Tcom", the data driver circuit 810 operates as follows. Each of the first switches 812 switches to connect the fixing terminal and the first switching terminal "A" so as to connect the input terminal of the amplifiers 813 to the single panel-common line "Com". Each of the second switches 814 switches to connect the fixing terminal and the first switching terminal "C" so as to connect the output terminal of the amplifiers 813 to the column-common voltage output terminal 115*b* which is connected to the separate column-common electrode line 832. A common voltage Vcom of the single panel-common line "Com" is transmitted through the amplifier 813 to the separate column-common electrode line 832.

Each of the data lines 831 and the separate column-common electrode line 832 has a parasitic capacitance which is caused by the fact that each of the data lines 831 and the separate column-common electrode line 832 extends to cross over the gate lines 833. The data line 831 and the separate column-common electrode line 832 hold the voltages one charged by the previous switching operations.

If, in this horizontal time period, the gate line "G1" has a high level potential to place the pixel transistor 841 into ON-state, the image signal on the data line 831 is transmitted through the pixel transistor 841 into the pixel electrode 843 of the pixel capacitance and also into the storage capacitance 842, whereby the pixel capacitance and the storage capacitance 842 are charged in accordance with the image signal voltage level.

In the next horizontal time period, the data driver circuit 810 operates as follows. In the first half period "Tdat", each of the first switches 812 switches to connect the fixing terminal and the second switching terminal "B" so as to connect the input terminal of the amplifiers 813 to the sample hold circuit 811. Each of the second switches 814 switches to connect the fixing terminal and the second switching terminal "D" so as to connect the output terminal of the amplifiers 813 to the image signal output terminal 115*a* which is connected to the data line 831. Image signal held in the sample hold circuit 811 are transmitted through the amplifiers 813 into the data lines 831.

In the second half period "Tcom", the data driver circuit 810 operates as follows. Each of the first switches 812 switches to connect the fixed terminal and the first switching terminal "A" so as to connect the input terminal of the amplifiers 813 to the single panel-common line "Com". Each of the second switches 814 switches to connect the fixing terminal and the first switching terminal "C" so as to connect the output terminal of the amplifiers 813 to the column-common voltage output terminal 115*b* which is connected to the separated column-common electrode line 832. A common voltage Vcom of the single panel-common line "Com" is transmitted through the amplifier 813 to the separate column-common electrode line 832.

Each of the data lines 831 and the separate column-common electrode line 832 has a parasitic capacitance which is caused by the fact that each of the data lines 831 and the separate column-common electrode line 832 extends to cross over the gate lines 833. The data line 831 and the separate column-common electrode line 832 hold the voltages one charged by the previous switching operations.

If, in this horizontal time period, the gate line "G2" has a high level potential to place the pixel transistor 841 into ON-state, the image signal on the data line 831 is transmitted through the pixel transistor 841 into the pixel electrode 843 of the pixel capacitance and also into the storage capacitance 842, whereby the pixel capacitance and the storage capacitance 842 are charged in accordance with the image signal voltage level.

The above operations are repeated for all of the gate lines G1, - - - Gm, so that image signals are written into all of the pixels.

With reference to FIG. 13, in odd frames, image signals to be written into the pixel electrodes 843 have positive polarity to the separate column-common voltages to be applied to the separate column-common electrodes 844. Images signals Vsig are supplied to the data driver circuit 810. The separate column-common electrodes 844 is applied with a voltage Vcomh and the date driver circuit 810 is applied with a voltage (Vvd+Vcomh) in order to apply the voltage Vvd to the liquid crystal between the separate columncommon electrodes 844 and the pixel electrodes 843.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 810 operates as follows. Each of the first switches 812 switches to connect the fixing terminal and the second switching terminal "B" so as to connect the input terminal of the amplifiers 813 to the sample hold circuit 811. Each of the second switches 814 switches to connect the fixing terminal and the second switching terminal "D" so as to connect the output terminal of the amplifiers 813 to the image signal output terminal 115*a* which is connected to the data line 831. Image signals held in the sample hold circuit 811 are transmitted through the amplifiers 813 into the data lines 831.

In the second half period "Tcom", the data driver circuit 810 operates as follows. Each of the first switches 812 switches to connect the fixing terminal and the first switching terminal "A" so as to connect the input terminal of the amplifiers 813 to the single panel-common line "Com". Each of the second switches 814 switches to connect the fixing terminal and the first switching terminal "C" so as to connect the output terminal of the amplifiers 813 to the column-common voltage output terminal 115*b* which is connected to the separate column-common electrode line 832. A common voltage Vcom of the single panel-common line "Com" is transmitted through the amplifier 813 to the separate column-common electrode line 832.

Each of the data lines 831 and the separate column-common electrode line 832 has a parasitic capacitance which is caused by the fact that each of the data lines 831 and the separate column-common electrode line 832 extends to cross over the gate lines 833. The data line 831 and the separate column-common electrode line 832 hold the voltages one charged by the previous switching operations.

If, in this horizontal time period, the gate line "G1" has a high level potential to place the pixel transistor 841 into ON-state, the image signal on the data line 831 is transmitted through the pixel transistor 841 into the pixel electrode 843 of the pixel capacitance and also into the storage capacitance 842, whereby the pixel capacitance and the storage capacitance 842 are charged in accordance with the image signal voltage level.

In the next horizontal time period, the data driver circuit 810 operates as follows, In the first half period "Tdat", each of the first switches 812 switches to connect the fixing terminal and the second switching terminal "B" so as to connect the input terminal of the amplifiers 813 to the sample hold circuit 811. Each of the second switches 814 switches to connect the fixing terminal and the second switching terminal "D" so as to connect the output terminal of the amplifiers 813 to the image signal output terminal 115*a* which is connected to the data line 831. Image signals held in the sample hold circuit 811 are transmitted through the amplifiers 813 into the data lines 831.

In the second half period "Tcom", the data driver circuit 810 operates as follows. Each of the first switches 812 switches to connect the fixing terminal and the first switching terminal "A" so as to connect the input terminal of the amplifiers 813 to the single panel-common line "Com". Each of the second switches 814 switches to connect the fixing terminal and the first switching terminal "C" so as to connect the output terminal of the amplifiers 813 to the column-common voltage output terminal 115*b* which is connected to the separate column-common electrode line 832. A common voltage Vcom of the single panel-common line "Com" is transmitted through the amplifier 813 to the separate column-common electrode line 832.

Each of the data lines 831 and the separate column-common electrode line 832 has a parasitic capacitance which is caused by the fact that each of the data lines 831 and the separate column-common electrode line 832 extends to cross over the gate lines 833. The data line 831 and the separate column-common electrode line 832 hold the voltages one charged by the previous switching operations.

If, in this horizontal time period, the gate line "G2" has a high level potential to place the pixel transistor 841 into ON-state, the image signal on the data line 831 is transmitted through the pixel transistor 841 into the pixel electrode 843 of the pixel capacitance and also into the storage capacitance 842, whereby the pixel capacitance and the storage capacitance 842 are charged in accordance with the image signal voltage level.

The above operations are repeated for all of the gate lines G1, - - - Gm, so that image signals are written into all of the pixels.

The voltage Vlc to be applied in the even frames to the liquid crystal between the pixel electrodes 843 and the separate column-common electrodes 844 corresponds to a potential difference between the pixel electrode 843 and the separate column-common electrode 844. The voltage Vlc to be applied in the even frames to the liquid crystal is given by the above equation (5).

Further, the voltage Vlc to be applied in the odd frames to the liquid crystal between the pixel electrodes 843 and the separate column-common electrodes 844 corresponds to a potential difference between the pixel electrode 843 and the separate column-common electrode 844. The voltage Vlc to be applied in the odd frames to the liquid crystal is given by the above equation (6).

In accordance with the second novel driving method, the image signals with the negative polarity are written in the even frames whilst the image signals with the positive polarity are written in the odd frames.

The above third novel liquid crystal display device operated in the above second driving method provides the following effects.

The data driver circuit 810 has the same number of or a larger number of the amplifiers 813 than the data lines 831 of the display panel 830. It is assumed that there are variations in off-set voltage among the amplifiers 813. The output from the amplifier 813 is given by the above equation (1).

If the above liquid crystal display is driven in the above described first driving method, then the voltages given by the above equations (2) and (3) are written into the pixel electrode 843 and the separate column-common electrode 814.

A voltage Vlc to be applied to liquid crystal between the pixel electrode 843 and the separate column-common electrode 844 corresponds to a potential difference between the pixel electrode 843 and the separate column-common electrode 844, for which reason the voltage Vlc to be applied to liquid crystal may be represented by the above equation (4).

The above equation (4) means that the voltage Vlc to be applied to liquid crystal is independent from the off-set voltage Voff of the amplifier 813. Accordingly, the voltage Vlc to be applied to liquid crystal is independent from variations in the off-set voltage Voff of the amplifiers 813. Namely, the voltage Vlc to be applied to liquid crystal remains unchanged even if there are variations in off-set voltage Voff among the amplifiers 813. The above third novel liquid crystal display operated in the above described first driving method is capable of applying a highly accurate voltage to the liquid crystal even if there are variations in off-set voltage Voff among the amplifiers 813.

The above third novel liquid crystal display device operated in the above second driving method provides further effects as follows.

It is possible to reduce the amplitude of the image signals into about one half, wherein the image signals are supplied to the data driver circuit 810.

If the liquid crystal display is driven by the conventional driving method, it is required to accomplish an alternating current driving to prevent any direct current voltage component from remaining in the voltage to be applied to the liquid crystal through plural frames so as to prevent that an electrolysis of the liquid crystal molecules is caused to generate ions in the liquid crystal molecules, whereby the generated ions generate local electric fields which displaces the intensity of the electric field applied between the pixel electrode and the column-common electrode.

In order to apply Vvcmax as a maximum voltage of the image signal into the liquid crystal, the separate column-common electrode 844 is fixed in potential at Vcom, whilst the voltage in the range of (−Vvcmax+Vcom) to (+Vvcmax+Vcom).

The maximum value of the amplitude of the image signals is 2×Vvcmax. It is also required that the range of amplitude of the amplifiers 813 in the data driver circuit 810 is over the above maximum value.

By contrast to the conventional driving method, if the liquid crystal display device is driven by the second novel driving method, then the amplitude of the image signal with the negative polarity to the separate column-common electrode potential is ranged from (−Vvcmax+Vcomh) to (Vcomh), whilst the amplitude of the image signal with the positive polarity to the separate column-common electrode potential is ranged from (Vcomh) to (Vvcmax+Vcomh).

If Vcomh=Vcoml+Vvcmax, the voltage range to be inputted into the amplifiers 813 are independent from the negative and positive polarities and are ranged from Vcoml to (Vvcmax+Vcoml), and the maximum amplitude is Vvcmax.

In accordance with the above second driving method, it is possible to reduce the amplitude of the image signals to be supplied to the data driver circuit 810 into about one half so that the required performances of the amplifiers are relaxed. Further, operational voltages necessary for the data driver circuit 810 is also reduced into about one half, whereby the power consumption of the liquid crystal display device is also reduced.

Figure 14:
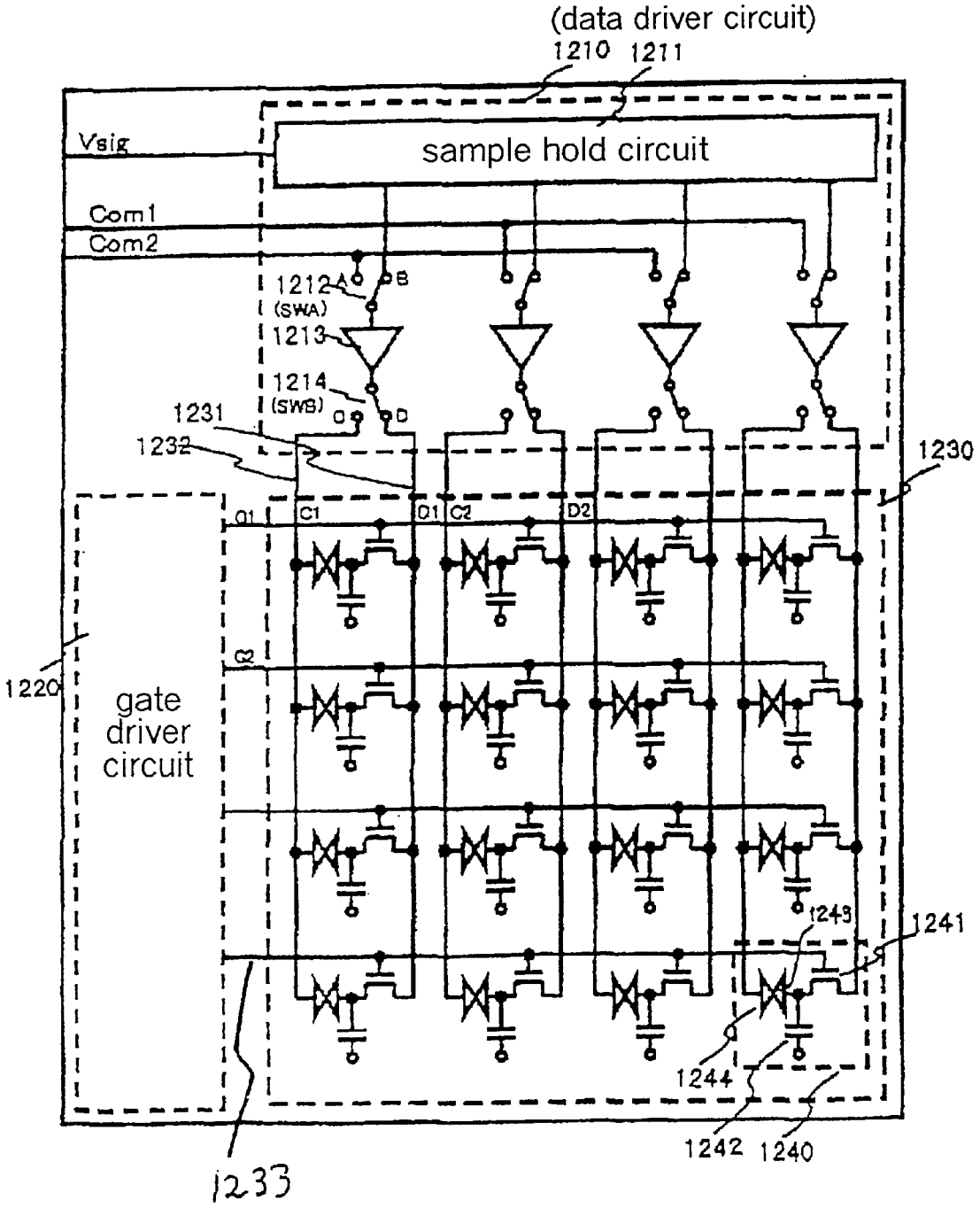
FIG. 14 is a circuit diagram illustrative of an equivalent circuit of a fourth novel in-plane switching mode active material liquid crystal display device in a fourth embodiment in accordance with the present invention.

A fourth embodiment according to the present invention will be described in detail with reference to the drawings. FIG. 14 is a circuit diagram illustrative of an equivalent circuit of a fourth novel in-plane switching mode active material liquid crystal display device in a fourth embodiment in accordance with the present invention.

The fourth novel in-plane switching mode active material liquid crystal display device comprises a data driver circuit 1210, a gate driver circuit 1220 and a liquid crystal display panel 1230 which is connected to the data driver circuit 1210 and the gate driver circuit 1220. The data driver circuit 1210, the gate driver circuit 1220 and the liquid crystal display panel 1230 are unitary formed. The liquid crystal display panel 1230 has an array of pixels 1240 which are aligned in matrix throughout the liquid crystal display panel 1230. The liquid crystal display panel 1230 also has a plurality of data lines 1231 which extend in parallel to each other in a column direction for transmission of data to the pixels 1240. The data lines 1231 are connected to the data driver circuit 1210. The liquid crystal display panel 1230 also has a plurality of gate lines 1233 which extend in parallel to each other but in a row direction perpendicular to the column direction along which the data lines 1231 extend. The gate lines 1233 are provided for transmission of gate control signals to the pixels 1240. The gate lines 1233 are connected to the gate driver circuit 1220. The pixels 1240 are positioned at crossing points of the data lines 1231 and the gate lines 1233. The liquid crystal display panel 1230 also has a plurality of separate column-common electrode lines 1232 which extend in parallel to each other but in the column direction perpendicular to the row direction along which the gate lines 1233 extend. The separate column-common electrode lines 1232 are provided for every column alignments of the pixels 1240, so that one of the separate column-common electrode lines 1232 is provided for corresponding one column alignment of the pixels 1240.

Each of the pixels 1240 is represented by a square-shaped broken line in FIG. 14. Each of the pixels 1240 further comprises a pixel transistor 1241, a storage capacitor 1242, a pixel electrode 1243 and a column-common electrode 1244. The pixel transistor 1241 comprises a thin film transistor formed in a substrate. The pixel transistor 1241 may comprise either an amorphous silicon thin film transistor or a polysilicon thin film transistor. The pixel transistor 1241 in each of the pixels 1240 has a gate electrode which is connected to corresponding one of the gate lines 1233. The pixel transistor 1241 in each of the pixels 1240 has a source electrode which is connected to corresponding one of the data lines 1231. The storage capacitor 1242 is connected between a drain electrode of the pixel transistor 1241 and a ground line. The pixel electrode 1243 in each of the pixels 1240 is connected to the drain electrode of the pixel transistor 1241. The column-common electrode 1244 in each of the pixels 1240 is connected to corresponding one of the separate column-common electrode lines 1232, so that a separately controlled column-common electrode voltage may be applied through the corresponding one of the separate column-common electrode lines 1232 to the column-common electrode 1244 of the pixels 1240. The data lines 1231 are driven by the data driver circuit 1210. The gate lines 1233 are driven by the gate driver circuit 1220.

The data driver circuit 1210 has a sample hold circuit 1211, a plurality of first switches 1212 provided for every columns of the pixels, a plurality of amplifiers 1213 provided for every columns of the pixels, a plurality of second switches 1214 provided for every columns of the pixels, plural pairs of an image signal output terminal 1215*a* and a column-common voltage output terminal 1215*b*. The sample hold circuit 1211 is provided for sampling and holding image signals for one horizontal time period. Each of the plural first switches 1212 is provided between the sample hold circuit 1211 and corresponding one of the plural amplifiers 1213. Each of the first switches 1212 has a fixing terminal connected to an input terminal of the corresponding one of the amplifiers 1213 and first and second switching terminals "A" and "B". The first switching terminal is connected to dual panel-common lines "Com1" and "Com2" extending in a row direction. The first switches 1212 aligned in the odd numbers from the most left end are connected through the first switching terminals "A" to the first panel-common line "Com1". The first switches 1212 aligned in the even numbers from the most left end are connected through the first switching terminals "A" to the second panel-common line "Com2". The second switching terminal "B" of each of the amplifier 1213 is connected to corresponding one of the output terminals of the sample hold circuit 1211. Each of the first switches 1212 aligned in the odd numbers from the left end is switched to connect the fixing terminal to either one of the first and second switching terminals "A" and "B" so that each of the first switches 1212 aligned in the odd numbers from the left end switches in one horizontal time period to transmit either one of output voltage from the sample hold circuit 1211 and a first panel-common voltage level of the first panel-common line "Com1". Each of the first switches 1212 aligned in the even numbers from the left end is switched to connect the fixing terminal to either one of the first and second switching terminals "A" and "B" so that each of the first switches 1212 aligned in the even numbers from the left end switches in one horizontal time period to transmit either one of output voltage from the sample hold circuit 1211 and a second panel-common voltage level of the second panel-common line "Com2". Each of the amplifiers 1213 has an input terminal connected to the fixing terminal of the first switch 1212 for receiving and amplifying selected one of the output voltage from the sample hold circuit 1211 and the first or second panel-common voltage level of the first or second panel-common line "Com1" or "Com2". The second switch 1214 is provided between the amplifier 1213 and both corresponding one of the separated column-common electrode lines 1232 and the corresponding data line 1231 in the display panel 1230. The second switch 1214 has a fixing terminal connected to an output terminal of the amplifier 1213 for receiving the amplified one of the output voltage from the sample hold circuit 1211 and the first or second panel-common voltage level of the first or second panel-common line "Com1" or "Com2". The second switch 1214 has a first switching terminal "C" connected to corresponding one of the separate column-common electrode lines 1232 provided for every columns of the pixels in the display panel. The second switch 1214 has as a second switching terminal "D" connected to corresponding one of the data lines 1231 or provided for every columns of the pixels in the display panel. Each of the second switches 1214 is switched to connect the fixing terminal to either one of the first and second switching terminals "C" and "D" so that each of the second switches 1214 switches in one horizontal time period to either transmit the amplified image signal voltage to the data line 1231 or transmit the amplified column-common electrode voltage to the corresponding separate column-common electrode line separately provided for the column. Namely, the first and second switches 1212 and 1214 are co-operated with each other so that, in one horizontal time period, the first switch 1212 connects the fixing terminal and the first switching terminal "A" and the second switch 1214 connects the fixing terminal and the first switching terminal "C" so as to connect the dual panel-common lines "Com1" and "Com2" to the separated column-common electrode line 1232 through the first and second switches 1212 and 1214 and the amplifier 1213, whereby to transmit the amplified column-common voltage onto the separated column-common electrode line 1232, and thus in the next horizontal time period, the first switch 1212 switches to connect the fixing terminal and the second switching terminal "B" and the second switch 1214 also switches to connect the fixing terminal and the first switching terminal "D" so as to connect the output terminal of the sample hold circuit 1211 to the data line 1231 through the first and second switches 1212 and 1214 and the amplifier 1213, whereby to transmit the amplified image signal voltage onto the data line 1231.

As described above, in accordance with the fourth novel in plane switching mode active matrix liquid crystal display device, the column-common electrode lines are separately provided for every columns for receiving column-common electrode voltages individually amplified by the amplifiers which serve to amplify the image signals for transmission thereof onto the counterpart data lines. The column-common electrode voltages individually amplified in every columns are written in horizontal blanking time periods. Namely, both the image signals to be transmitted onto the data line and the column-common voltages to be transmitted onto the counterpart separate column-common electrode line which makes the same column with the data line are amplified by the same amplifier, so that even if any variation in off-set is caused between the plural amplifiers, it is possible to cause a highly accurate potential difference between the pixel electrode applied with the image signal having been transmitted on the data line and the separate column-common electrode applied with the individual column-common voltage having been transmitted on the separate column-common electrode line, whereby an electric field with an highly accurate intensity is applied across the liquid crystal between the pixel electrode and the column-common electrode in each of the pixels.

The display panel is driven by an alternate current driving method, wherein the voltage to be applied across the liquid crystal between the pixel electrode and the column-common electrode is inverted or changed in polarity for every frames. Further, different column-common voltage levels are applied to the column-common electrode between a first frame in applying a positive polarity voltage to the pixel electrode and a second frame in applying a negative polarity voltage to the pixel electrode, so as to allow that an amplitude in voltage level of the image signals to be applied to the pixel electrode is reduced into about one half of that necessary when a fixed column-common voltage level remains applied to the column-common electrode between the first and second frames. This reduction in the necessary amplitude in voltage level of the image signals by applying the different column-common voltage levels to the column-common electrode between the first and second frames allows relaxing operational conditions of the amplifiers, namely makes it easy to design the amplifiers.

The following descriptions will focus on the operations of the above display device.

Figure 15:
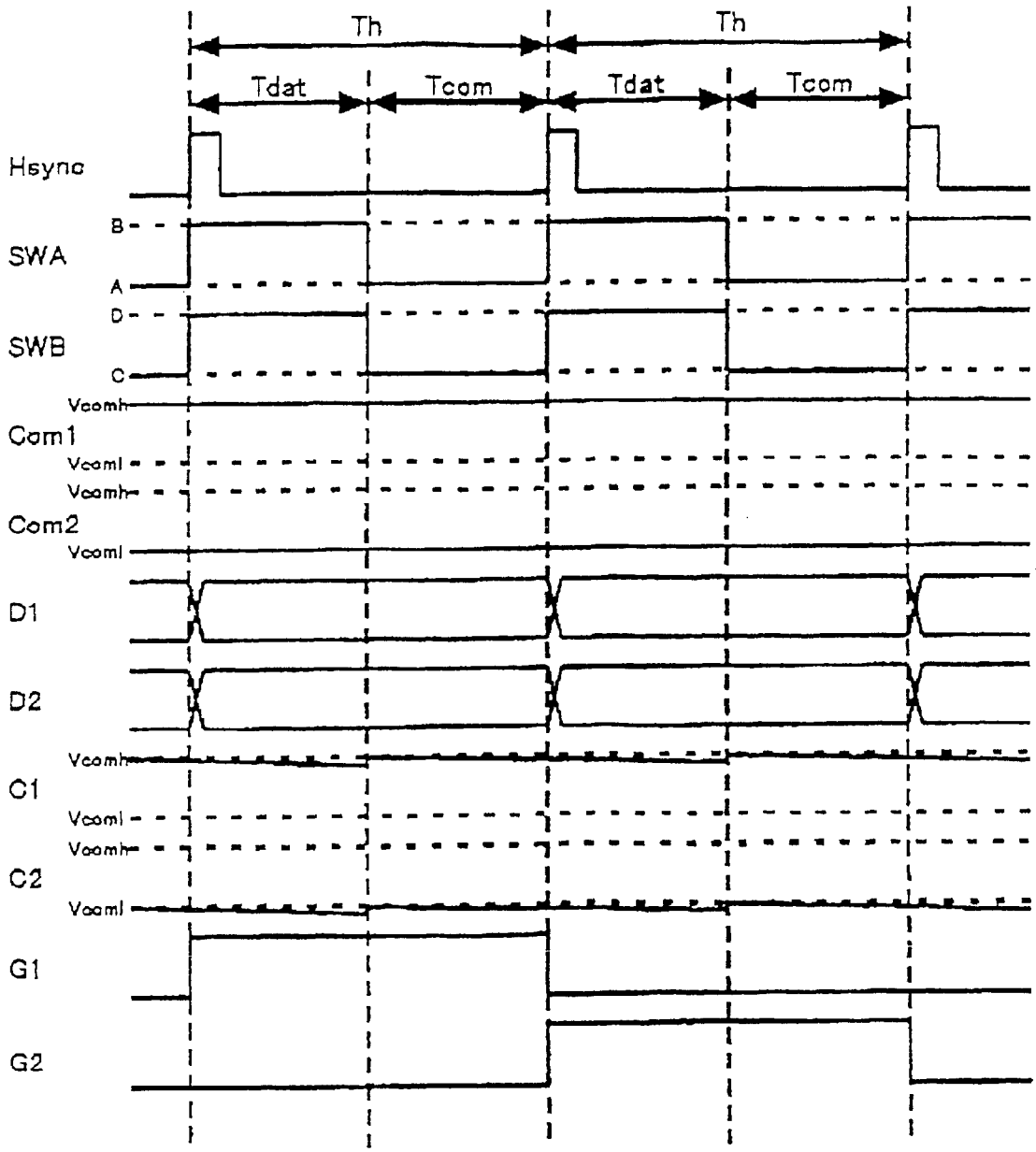
FIG. 15 is a timing chart illustrative of waveforms in even frames of a horizontal synchronizing signal Hsync, first and second panel-common electrode potentials Com1 and Com2, a first data line potential D1 of first one of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the fourth novel in-plane switching mode active material liquid crystal display device of FIG. 14.
Figure 16:
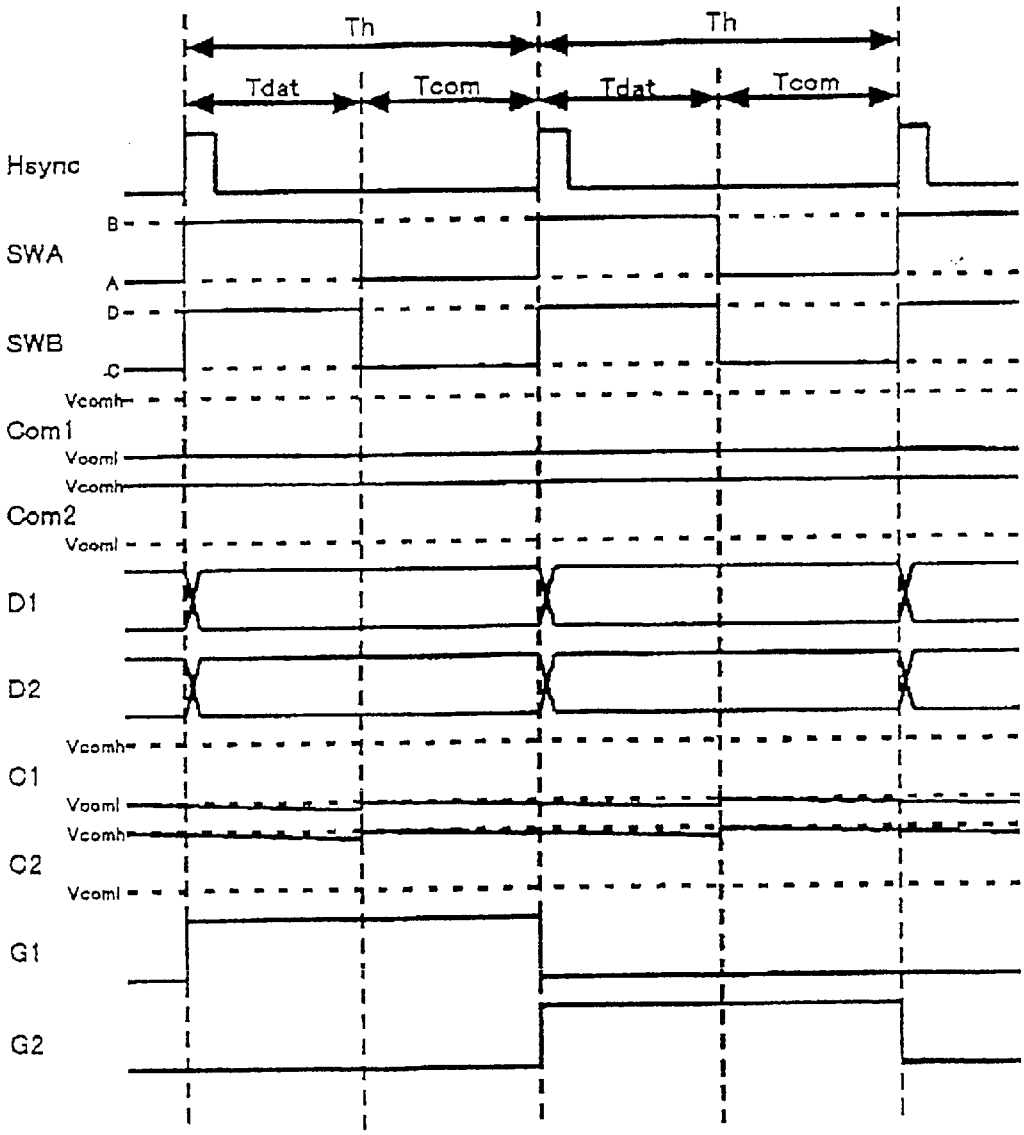
FIG 16 is a timing chart illustrative of waveforms in odd frames of a horizontal synchronizing signal Hsync, first and second panel-common electrode potentials Com1 and Com2, a first data line potential D1 of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the fourth novel in-plane switching mode active material liquid crystal display device of FIG. 14.

FIG. 15 is a timing chart illustrative of waveforms in even frames of a horizontal synchronizing signal Hsync, first and second panel-common electrode potentials Com1 and Com2, a first data line potential D1 of first one of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the fourth novel in-plane switching mode active material liquid crystal display device of FIG. 14. FIG. 16 is a timing chart illustrative of waveforms in odd frames of a horizontal synchronizing signal Hsync, first and second panel-common electrode potentials Com1 and Com2, a first data line potential D1 of odd number data lines aligned in the odd numbers from the left end, a second data line potential D2 of even number data lines aligned in the even numbers from the left end, a first gate line potential G1 of first one of adjacent two gate lines, and a second gate line potential G2 of second one of the adjacent two gate lines to explain the driving method of the fourth novel in-plane switching mode active material liquid crystal display device of FIG. 14.

With reference to FIG. 15, in the even frames, image signals to be written through the even number data lines into the pixel electrodes 1243 have negative polarity to the separate column-common voltages to be applied to the separate column-common electrodes 1244, whilst image signals to be written through the odd number data lines into the pixel electrodes 1243 have positive polarity to the separate column-common voltages to be applied to the separate column-common electrodes 1244. Images signals Vsig are supplied to the data driver circuit 1210. The odd number data lines are applied with a voltage (Vvd+Vcomh), whilst the even number data lines are applied with a voltage (−Vvd+Vcomh) in order to apply the voltage Vvd to the liquid crystal between the separate column-common electrodes 1244 and the pixel electrodes 1243. The first panel-common line Com1 is applied with a first panel-common voltage level Vcomh, whilst the second panel-common line Com2 is applied with a second panel-common voltage level Vcoml.

The liquid crystal display has one horizontal time period "Th" which corresponds to a time period of horizontal synchronous signal Hsync during which image signals for one row are written into the liquid crystal display. The horizontal time period "Th"is divided into a first half period "Tdat" and a second half period "Tcom" following to the first half period "Tdat".

In the first half period "Tdat", the data driver circuit 1210 operates as follows. Each of the first switches 1212 switches to connect the fixing terminal and the second switching terminal "B" so as to connect the input terminal of the amplifiers 1213 to the sample hold circuit 1211. Each of the second switches 1214 switches to connect the fixing terminal and the second switching terminal "D" so as to connect the output terminal of the amplifiers 1213 to the data line 1231. Image signals held in the sample hold circuit 1211 are transmitted through the amplifiers 1213 into the data lines 1231.

In the second half period "Tcom", the data driver circuit 1210 operates as follows. Each of the first switches 1212 switches to connect the fixing terminal and the first switching terminal "A" so as to connect the input terminal of the amplifiers 1213 to the first and second panel-common lines "Com1" and "Com2". Each of the second switches 1214 switches to connect the fixing terminal and the first switching terminal "C" so as to connect the output terminal of the amplifiers 1213 to the separate column-common electrode line 1232. The first panel-common voltage Vcomh of the first panel-common line "Com1" is transmitted through the amplifier 1213 to the even number separate column-common electrode line 1232 aligned in the even numbers from the left end. The second panel-common voltage Vcoml of the second panel-common line "Com2" is transmitted through the amplifier 1213 to the odd number separate column-common electrode line 1232 aligned in the odd numbers from the left end.

Each of the data lines 1231 and the separate column-common electrode line 1232 has a parasitic capacitance which is caused by the fact that each of the data lines 1231 and the separate column-common electrode line 1232 extends to cross over the gate lines 1233. The data line 1231 and the separate column-common electrode line 1232 hold the voltages one charged by the previous switching operations.

If, in this horizontal time period, the gate line "G1" has a high level potential to place the pixel transistor 1241 into ON-state, the image signal on the data line 1231 is transmitted through the pixel transistor 1241 into the pixel electrode 1243 of the pixel capacitance and also into the storage capacitance 1242, whereby the pixel capacitance and the storage capacitance 1242 are charged in accordance with the image signal voltage level.

In the next horizontal time period, the data driver circuit 1210 operates as follows. In the first half period "Tdat", each of the first switches 1212 switches to connect the fixing terminal and the second switching terminal "B" so as to connect the input terminal of the amplifiers 1213 to the sample hold circuit 1211. Each of the second switches 1214 switches to connect the fixing terminal and the second switching terminal "D" so as to connect the output terminal of the amplifiers 1213 to the data line 1231. Image signals held in the sample hold circuit 1211 are transmitted through the amplifiers 1213 into the data lines 1231.

In the second half period "Tcom", the data driver circuit 1210 operates as follows. Each of the first switches 1212 switches to connect the fixing terminal and the first switching terminal "A" so as to connect the input terminal of the amplifiers 1213 to the single panel-common line "Com". Each of the second switches 1214 switches to connect the fixing terminal and the first switching terminal "C" so as to connect the output terminal of the amplifiers 1213 to the separate column-common electrode line 1232. The first common voltage Vcomh of the first panel-common line "Com1" is transmitted through the amplifier 1213 to the even number separate column-common electrode lines 1232 align in the even number from the left end. The second common voltage Vcoml of the second panel-common line "Com2" is transmitted through the amplifier 1213 to the odd number separate column-common electrode lines 1232 align in the odd number from the left end.

Each of the data lines 1231 and the separate column-common electrode line 1232 has a parasitic capacitance which is caused by the fact that each of the data lines 1231 and the separate column-common electrode line 1232 extends to cross over the gate lines 1233. The data line 1231 and the separate column-common electrode line 1232 hold the voltages one charged by the previous switching operations.

If, in this horizontal time period, the gate line "G2" has a high level potential to place the pixel transistor 1241 into ON-state, the image signal on the data line 1231 is transmitted through the pixel transistor 1241 into the pixel electrode 1243 of the pixel capacitance and also into the storage capacitance 1242, whereby the pixel capacitance and the storage capacitance 1242 are charged in accordance with the image signal voltage level.

The above operations are repeated for all of the gate lines G1, - - - Gm, so that image signals are written into all of the pixels.

With reference to FIG. 16, in odd frames, image signals to be written through the odd number data lines into the pixel electrodes 1243 have negative polarity to the separate column-common voltages to be applied to the separate column-common electrodes 1244, whilst image signals to be written through the even number data lines into the pixel electrodes 1243 have positive polarity to the separate column-common voltages to be applied to the separate column-common electrodes 1244. Images signals Vsig are supplied to the data driver circuit 1210. The even number data lines are applied with a voltage (Vvd+Vcomh), whilst the odd number data lines are applied with a voltage (−Vvd+Vcomh) in order to apply the voltage Vvd to the liquid crystal between the separate column-common electrodes 1244 and the pixel electrodes 1243. The first panel-common line Com1 is applied with a first panel-common voltage level Vcomh, whilst the second panel-common line Com2 is applied with a second panel-common voltage level Vcoml.

The liquid crystal display has one horizontal time period "Th" which corresponds to a time period of horizontal synchronous signal Hsync during which image signals for one row are written into the liquid crystal display. The horizontal time period "Th" is divided into a first half period "Tdat" and a second half period "Tcom" following to the first half period "Tdat".

In the first half period "Tdat", the data driver circuit 1210 operates as follows. Each of the first switches 1212 switches to connect the fixing terminal and the second switching terminal "B" so as to connect the input terminal of the amplifiers 1213 to the sample hold circuit 1211. Each of the second switches 1214 switches to connect the fixing terminal and the second switching terminal "D" so as to connect the output terminal of the amplifiers 1213 to the image signal output terminal 515*a* which is connected to the data line 1231. Image signals held in the sample hold circuit 1211 are transmitted through the amplifiers 1213 into the data lines 1231.

In the second half period "Tcom", the data driver circuit 1210 operates as follows. Each of the first switches 1212 switches to connect the fixing terminal and the first switching terminal "A" so as to connect the input terminal of the amplifiers 1213 to the single panel-common line "Com". Each of the second switches 1214 switches to connect the fixing terminal and the first switching terminal "C" so as to connect the output terminal of the amplifiers 1213 to the separate column-common electrode line 1232. The first panel-common voltage Vcomh of the first panel-common line "Com1" is transmitted through the even number amplifier 1213 to the even number separate column-common electrode lines 1232 The second panel-common voltage Vcoml of the second panel-common line "Com2" is transmitted through the odd number amplifier 1213 to the odd number separate column-common electrode lines 1232.

Each of the data lines 1231 and the separate column-common electrode line 1232 has a parasitic capacitance which is caused by the fact that each of the data lines 1231 and the separate column-common electrode line 1232 extends to cross over the gate lines 1233. The data line 1231 and the separate column-common electrode line 1232 hold the voltages one charged by the previous switching operations.

If, in this horizontal time period, the gate line "G1" has a high level potential to place the pixel transistor 1241 into ON-state, the image signal on the data line 1231 is transmitted through the pixel transistor 1241 into the pixel electrode 1243 of the pixel capacitance and also into the storage capacitance 1242, whereby the pixel capacitance and the storage capacitance 1242 are charged in accordance with the image signal voltage level.

In the next horizontal time period, the data driver circuit 1210 operates as follows. In the first half period "Tdat", each of the first switches 1212 switches to connect the fixing terminal and the second switching terminal "B" so as to connect the input terminal of the amplifiers 1213 to the sample hold circuit 1211. Each of the second switches 1214 switches to connect the fixing terminal and the second switching terminal "D" so as to connect the output terminal of the amplifiers 1213 to the image signal output terminal 515*a* which is connected to the data line 1231. Image signals held in the sample hold circuit 1211 are transmitted through the amplifiers 1213 into the data lines 1231.

In the second half period "Tcom", the data driver circuit 1210 operates as follows. Each of the first switches 1212 switches to connect the fixing terminal and the first switching terminal "A" so as to connect the input terminal of the amplifiers 1213 to the single panel-common line "Com". Each of the second switches 1214 switches to connect the fixing terminal and the first switching terminal "C" so as to connect the output terminal of the amplifiers 1213 to the separate column-common electrode line 1232. The first common voltage Vcomh of the first panel-common lines "Com1" is transmitted through the even number amplifiers 1213 to the even number separate column-common electrode lines 1232. The second common voltage Vcoml of the second panel-common lines "Com2" is transmitted through the odd number amplifiers 1213 to the odd number separate column-common electrode lines 1232.

Each of the data lines 1231 and the separate column-common electrode line 1232 has a parasitic capacitance which is caused by the fact that each of the data lines 1231 and the separate column-common electrode line 1232 extends to cross over the gate lines 1233. The data line 1231 and the separate column-common electrode line 1232 hold the voltages one charged by the previous switching operations.

If, in this horizontal time period, the gate line "G2" has a high level potential to place the pixel transistor 1241 into ON-state, the image signal on the data line 1231 is transmitted through the pixel transistor 1241 into the pixel electrode 1243 of the pixel capacitance and also into the storage capacitance 1242, whereby the pixel capacitance and the storage capacitance 1242 are charged in accordance with the image signal voltage level.

The above operations are repeated for all of the gate lines G1, - - - Gm, so that image signals are written into all of the pixels.

The negative voltage −Vlc to be applied in the even frames to the liquid crystal between the even number pixel electrodes 1243 and the even number separate column-common electrodes 1244 corresponds to a potential difference between the even number pixel electrode 1243 and the even number separate column-common electrode 1244. The negative voltage −Vlc to be applied in the even frames to the even number liquid crystal is given by the above equation (7).

Further, the positive voltage Vlc to be applied in the odd frames to the odd number liquid crystal between the odd number pixel electrodes 1243 and the odd number separate column-common electrodes 1244 corresponds to a potential difference between the odd number pixel electrode 1243 and the odd number separate column-common electrode 1244. The positive voltage Vlc to be applied in the odd frames to the odd number liquid crystal is given by the above equation (8).

In accordance with the third novel driving method, in the even frame, the image signals with the negative polarity with reference to the even number separate column-common electrode lines are written into the even number pixel electrodes, whilst the image signals with the positive polarity with reference to the odd number separate column-common electrode lines are written into the odd number pixel electrodes. In the odd frame, the image signals with the positive polarity with reference to the even number separate column-common electrode lines are written into the even number pixel electrodes, whilst the image signals with the negative polarity with reference to the odd number separate column-common electrode lines are written into the odd number pixel electrodes.

The above fourth novel liquid crystal display device operated in the above third driving method provides the following effects.

The data driver circuit 1210 has the same number of or a larger number of the amplifiers 1213 than the data lines 1231 of the display panel 1230. It is assumed that there are variations in off-set voltage among the amplifiers 1213. The output from the amplifier 1213 is given by the above equation (1).

If the above liquid crystal display is driven in the above described first driving method, then the voltages given by the above equations (2) and (3) are written into the pixel electrode 1243 and the separate column-common electrode 1214.

A voltage Vlc to be applied to liquid crystal between the pixel electrode 1243 and the separate column-common electrode 1244 corresponds to a potential difference between the pixel electrode 1243 and the separate column-common electrode 1244, for which reason the voltage Vlc to be applied to liquid crystal may be represented by the above equation (4).

The above equation (4) means that the voltage Vlc to be applied to liquid crystal is independent from the off-set voltage Voff of the amplifier 1213. Accordingly, the voltage Vlc to be applied to liquid crystal is independent from variations in the off-set voltage Voff of the amplifiers 1213. Namely, the voltage Vlc to be applied to liquid crystal remains unchanged even if there are variations in off-set voltage Voff among the amplifiers 1213. The above fourth novel liquid crystal display operated in the above described first driving method is capable of applying a highly accurate voltage to the liquid crystal even if there are variations in off-set voltage Voff among the amplifiers 1213.

The above fourth novel liquid crystal display device operated in the above second driving method provides further effects as follows.

It is possible to reduce the amplitude of the image signals into about one half, wherein the image signals are supplied to the data driver circuit 1210.

If the liquid crystal display is driven by the conventional driving method, it is required to accomplish an alternating current driving to prevent any direct current voltage component from remaining in the voltage to be applied to the liquid crystal through plural frames so as to prevent that an electrolysis of the liquid crystal molecules is caused to generate ions in the liquid crystal molecules, whereby the generated ions generate local electric fields which displaces the intensity of the electric field applied between the pixel electrode and the column-common electrode.

In order to apply Vvcmax as a maximum voltage of the image signal into the liquid crystal, the separate column-common electrode 1244 is fixed in potential at Vcom, whilst the voltage in the range of (−Vvcmax+Vcom) to (+Vvcmax+Vcom).

The maximum value of the amplitude of the image signals is 2×Vvcmax. It is also required that the range of amplitude of the amplifiers 1213 in the data driver circuit 1210 is over the above maximum value.

By contrast to the conventional driving method, if the liquid crystal display device is driven by the second novel driving method, then the amplitude of the image signal with the negative polarity to the separate column-common electrode potential is ranged from (−Vvcmax+Vcomh) to (Vcomh), whilst the amplitude of the image signal with the positive polarity to the separate column-common electrode potential is ranged from (Vcomh) to (Vvcmax+Vcomh).

If Vcomh=Vcoml+Vvcmax, the voltage range to be inputted into the amplifiers 1213 are independent from the negative and positive polarities and are ranged from Vcoml to (Vvcmax+Vcoml), and the maximum amplitude is Vvcmax.

In accordance with the above second driving method, it is possible to reduce the amplitude of the image signals to be supplied to the data driver circuit 1210 into about one half so that the required performances of the amplifiers are relaxed. Further, operational voltages necessary for the data driver circuit 1210 is also reduced into about one half, whereby the power consumption of the liquid crystal display device is also reduced.

The above fourth novel liquid crystal display device operated in the above second driving method provides further more effects as follows.

The polarities of the image signals to be applied to the pixels connected to the even number data lines and the odd number data lines are inverted between in the even frames and the odd frames. For example, in the even frame, the image signals with the negative polarity with reference to the even number separate column-common electrode lines are written into the even number pixel electrodes, whilst the image signals with the positive polarity with reference to the odd number separate column-common electrode lines are written into the odd number pixel electrodes. In the odd frame, the image signals with the positive polarity with reference to the even number separate column-common electrode lines are written into the even number pixel electrodes, whilst the image signals with the negative polarity with reference to the odd number separate column-common electrode lines are written into the odd number pixel electrodes. This alternating driving method reduces a flicker of the display.

The primary reason for causing the flicker is as follows. A filed through voltage caused by turning ON and OFF of the pixel transistor is different dependent upon the polarity of the pixel voltage to be applied to the pixel electrode, wherein the polarity of the pixel voltage is decided with reference to the common electrode. The difference in the field through voltage causes that the actually applied voltage to the liquid crystal is lightly different from the potential written onto the data line, for which reason even if the same image signals are written into the liquid crystal, the flicker is caused by a slight difference in light transmittance of the liquid crystal. However, in accordance with the present invention, in each frame, almost the same number of the pixels are applied with the image signals with the positive and negative polarities with reference to the common electrode potential, an influence of the flicker is substantially cancelled. Namely, the flicker is reduced.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A data driver circuit for an active matrix liquid crystal display device having an array of pixels aligned in matrix, and each column of said pixels having a pair of a separate data line and a separate column-common line which are separated from any other columns, wherein said data driver circuit has a plurality of selectors, each of which is connected to corresponding one of plural sets of said separate data line and said separate column-common line, so that each of said selectors selects any one of a first transmission of image signals through said selector to said data line and a second transmission of at least one column-common voltage onto said separate column-common line.

2. The data driver circuit as claimed in claim 1, wherein each of said selectors has at least one amplifier for amplifying said image signals and said column-common voltage.

3. The data driver circuit as claimed in claim 1, wherein said data driver comprises:

at least a sample hold circuit for supplying image signals;

a single panel-common line for transmission of a panel-common voltage; and a plurality of said selectors provided for every columns of said pixels, and wherein each of said selectors further comprises:

a first switch connected to an output terminal of said sample hold circuit and also connected to said single panel-common line for selecting any one of said image signals and said panel-common voltage;

an amplifier having an input terminal connected to said first switch for amplifying selected one of said image signals and said panel-common voltage; and a second switch connected to an output terminal of said amplifier for selecting any one of a first transmission of amplified image signals to said separate data line and a second transmission of amplified panel-common voltage to said separate column-common.

4. The data driver circuit as claimed in claim 3, wherein said data driver circuit is separately provided from said array of said pixels.

5. The data driver circuit as claimed in claim 3, wherein said data driver circuit is unitary provided with said array of said pixels.

6. The data driver circuit as claimed in claim 1, wherein said data driver circuit comprises:

at least a sample hold circuit for supplying image signals;

a first panel-common line for transmission of a first panel-common voltage;

a second panel-common line for transmission of a second panel-common voltage; and a plurality of said selectors provided for every columns of said pixels, said selectors being alternately connected to said first and second panel-common lines, and wherein each of said selectors further comprises:

a first switch connected to an output terminal of said sample hold circuit and also connected to either said first or second panel-common line for selecting any one of said image signals and either said first or second panel-common voltage;

an amplifier having an input terminal connected to said first switch for amplifying selected one of said image signals and said panel-common voltage; and a second switch connected to an output terminal of said amplifier for selecting any one of a first transmission of amplified image signals to said separate data line and a second transmission of amplified panel-common voltage to said separate column-common.

7. The data driver circuit as claimed in claim 6, wherein said data driver circuit is separately provided from said array of said pixels.

8. The data driver circuit as claimed in claim 6, wherein said data driver circuit is unitary provided with said array of said pixels.

9. The data driver circuit as claimed in claim 1, wherein said data driver circuit supplies said image signals which have a predetermined unchanged polarity with reference to said column-common voltage.

10. The data driver circuit as claimed in claim 1, wherein said data driver circuit supplies said image signals which have alternatively inverted polarities with reference to said column-common voltage, where said polarities are alternatively inverted between in adjacent two frames.

11. A liquid crystal display device comprising:

a display panel having an array of pixels aligned in matrix, and each column of said pixels having a pair of a separate data line and a separate column-common line which are separated from any other columns, and each row of said pixels having a gate line;

a data driver circuit connected to said separate data lines and said separate column-common lines; and a gate driver circuit connected to said gate lines, wherein said data driver circuit has a plurality of selectors, each of which is connected to corresponding one of plural sets of said separate data line and said separate column-common line, so that each of said selectors selects any one of a first transmission of image signals through said selector to said data line and a second transmission of at least one column-common voltage onto said separate column-common line.

12. The liquid crystal display device as claimed in claim 11, wherein each of said selectors has at least one amplifier for amplifying said image signals and said column-common voltage.

13. The liquid crystal display device as claimed in claim 11, wherein said data driver comprises:

at least a sample hold circuit for supplying image signals;

a single panel-common line for transmission of a panel-common voltage; and a plurality of said selectors provided for every columns of said pixels, and wherein each of said selectors further comprises:

a first switch connected to an output terminal of said sample hold circuit and also connected to said single panel-common line for selecting any one of said image signals and said panel-common voltage;

an amplifier having an input terminal connected to said first switch for amplifying selected one of said image signals and said panel-common voltage; and a second switch connected to an output terminal of said amplifier for selecting any one of a first transmission of amplified image signals to said separate data line and a second transmission of amplified panel-common voltage to said separate column-common.

14. The liquid crystal display device as claimed in claim 13, wherein said data driver circuit is separately provided from said array of said pixels.

15. The liquid crystal display device as claimed in claim 13, wherein said data driver circuit is unitary provided with said array of said pixels.

16. The liquid crystal display device as claimed in claim 11, wherein said data driver circuit comprises:

at least a sample hold circuit for supplying image signals;

a first panel-common line for transmission of a first panel-common voltage;

a second panel-common line for transmission of a second panel-common voltage; and a plurality of said selectors provided for every columns of said pixels, said selectors being alternately connected to said first and second panel-common lines, and wherein each of said selectors further comprises:

a first switch connected to an output terminal of said sample hold circuit and also connected to either said first or second panel-common line for selecting any one of said image signals and either said first or second panel-common voltage;

an amplifier having an input terminal connected to said first switch for amplifying selected one of said image signals and said panel-common voltage; and a second switch connected to an output terminal of said amplifier for selecting any one of a first transmission of amplified image signals to said separate data line and a second transmission of amplified panel-common voltage to said separate column-common.

17. The liquid crystal display device as claimed in claim 16, wherein said data driver circuit is separately provided from said array of said pixels.

18. The liquid crystal display device as claimed in claim 16, wherein said data driver circuit is unitary provided with said array of said pixels.

19. The liquid crystal display device as claimed in claim 11, wherein said data driver circuit supplies said image signals which have a predetermined unchanged polarity with reference to said column-common voltage.

20. The liquid crystal display device as claimed in claim 11, wherein said data driver circuit supplies said image signals which have alternatively inverted polarities with reference to said column-common voltage, where said polarities are alternatively inverted between in adjacent two frames.

21. The liquid crystal display device as claimed in claim 11, wherein said liquid crystal display device is an active matrix liquid crystal display device operated in in-plane switching mode.

22. A method of driving a liquid crystal display device having an array of pixels aligned in a matrix, and each column of said pixels having a pair of a separate data line and a separate column-common line which are separated from any other columns, comprising the steps of:

applying an independent and separately amplified column-common voltage to each of said separate column-common lines; and amplifying said column-common voltage with an amplifier, the amplifier also amplifying image signals transmitted onto a corresponding data line of the pair of a separate column-common line and a separate data line.

23. The method as claimed in claim 22, wherein said data driver circuit supplies said image signals which have a predetermined unchanged polarity with reference to said column-common voltage.

24. The method as claimed in claim 23, wherein said data driver circuit supplies said image signals which have alternatively inverted polarities with reference to said column-common voltage, where said polarities are alternatively inverted between in adjacent two frames.

25. The method as claimed in claim 22, wherein said column-common voltage is applied in at least a predetermined time period which is within one horizontal time period and other than a writing time period for writing data.

26. A data drive circuit for an active matrix liquid crystal display comprising:

an array of pixels aligned in a matrix, each column of the pixels having a pair of a separate data line and a separate column-common line which are separated from any other columns;

a sample hold circuit for supplying an image signal to said separate data line;

a single panel-common line for transmitting a panel-common voltage to said separate column-common line;

a first selector for selecting between said image signal and said panel-common voltage;

a second selector for selecting between said separate data line and said separate column-common line; and an amplifier having an input connected to said first selector and an output connected to said second selector for amplifying one of said image signal and said panel-common voltage;

wherein the first and second selectors are connected so that for each said column of pixels, the amplifier input is connected, in a first state, to the single panel-column line and the output is connected to said separate column-common line and in a second state, the amplifier input is connected to said sample hold circuit and the output is connected to said separate data line.

* * * * *